US008519659B2

(12) United States Patent
Someya

(10) Patent No.: US 8,519,659 B2
(45) Date of Patent: Aug. 27, 2013

(54) ELECTRIC SERVO-PRESS, AND CONTROL DEVICE AND CONTROL METHOD FOR ELECTRIC SERVO PRESS

(75) Inventor: Atsushi Someya, Kanagawa (JP)

(73) Assignee: Aida Engineering, Ltd., Kanagawa (JP)

( * ) Notice: Subject to any disclaimer, the term of this patent is extended or adjusted under 35 U.S.C. 154(b) by 534 days.

(21) Appl. No.: 12/812,012

(22) PCT Filed: Feb. 8, 2008

(86) PCT No.: PCT/JP2008/000188
§ 371 (c)(1),
(2), (4) Date: Jul. 7, 2010

(87) PCT Pub. No.: WO2009/087704
PCT Pub. Date: Jul. 16, 2009

(65) Prior Publication Data

US 2011/0109257 A1 May 12, 2011

(30) Foreign Application Priority Data

Jan. 8, 2008 (JP) ..... 2008-001479

(51) Int. Cl.
*G05B 5/00* (2006.01)

(52) U.S. Cl.
USPC ..... 318/626; 318/569; 318/560

(58) Field of Classification Search
USPC ..... 318/626, 569, 560, 600, 625, 638, 318/594, 630
See application file for complete search history.

(56) References Cited

U.S. PATENT DOCUMENTS

2005/0189900 A1* 9/2005 Beyer et al. ..... 318/625

FOREIGN PATENT DOCUMENTS

| | | | |
|---|---|---|---|
| JP | 2-87986 | A | 3/1990 |
| JP | 9-11181 | A | 1/1997 |
| JP | 2003-205397 | A | 7/2003 |
| JP | 2003-290986 | A | 10/2003 |
| JP | 2003-290986 | A | 10/2003 |
| JP | 2003-290997 | A | 10/2003 |
| JP | 2004-23838 | A | 1/2004 |
| JP | 2004-023838 | A | 1/2004 |
| JP | 2004-025287 | A | 1/2004 |
| JP | 2004-25287 | A | 1/2004 |

(Continued)

OTHER PUBLICATIONS

Supplementary European Search Report for EP Patent Application No. 08710342, mailed on Feb. 2, 2012, and which corresponds to the present application.

(Continued)

*Primary Examiner* — Karen Masih
(74) *Attorney, Agent, or Firm* — McDermott Will & Emery LLP

(57) ABSTRACT

Provided is a low-cost control device for an electric servo press, which is excellent in operability and operation efficiency, capable of abruptly stopping a servomotor in a safe and reliable manner within a short time period in response to an abrupt stop command while avoiding hard actuation of a mechanical brake, even in the case of runaway of the servomotor or the like. An electric servo press performs switching to rotation stop control for a servomotor according to an abrupt stop motion based on an abrupt stop command signal to perform brake actuation to cause a mechanical brake to actually start braking and to forcibly interrupt rotational drive power to the servomotor at a scheduled stop time at which the servomotor is stopped according to the abrupt stop motion.

15 Claims, 8 Drawing Sheets

(56) References Cited

FOREIGN PATENT DOCUMENTS

| | | | |
|---|---|---|---|
| JP | 2005-125330 | A | 5/2005 |
| JP | 2005-199314 | A | 7/2005 |
| JP | 2005-219089 | A | 8/2005 |
| JP | 2005-271166 | A | 10/2005 |
| JP | 2007203353 | A | 8/2007 |

OTHER PUBLICATIONS

Chinese Office Action issued in Chinese Application No. 200880124330.4 mailed on Oct. 29, 2012.

* cited by examiner

AIRCRAFT STOP SIGNAL (Skt)
BRAKE SIGNAL
IN-CYLINDER PRESSURE
BRAKE STROKE
ROTATIONAL DRIVING FORCE INTERRUPTION SIGNAL
ROTATIONAL DRIVE POWER SOURCE (Vmt)
MOTOR ROTATION SPEED
OFF
OFF
OFF
t0
t1
t2
t3
t4
Tm
t31
t32
T11
T12
T1
Tf1
Tf2
T2
T21
T22
Tb
Tb
CRVb
CRVb-1
CRVs
CRVs-2
CRVs-1
Vmax
V1
V
0
TIME

ELECTRIC SERVO-PRESS, AND CONTROL DEVICE AND CONTROL METHOD FOR ELECTRIC SERVO PRESS

CROSS REFERENCE TO PRIOR APPLICATIONS

This application is a U.S. National Phase application under 35 U.S.C. §371 of International Application No. PCT/JP2008/000188, filed on Feb. 8, 2008 and claims benefit of priority to Japanese Patent Application No. 2008-001479, filed on Jan. 8, 2008. The International Application was published in Japanese on Jul. 16, 2009 as WO 2009/087704 A1 under PCT Article 21(2). All these applications are herein incorporated by reference.

TECHNICAL FIELD

The present invention relates to a technology of controlling an electric servo press for converting rotation of a servomotor into vertical reciprocating movement of a slide through an intermediation of a power transmission/conversion mechanism so as to use the vertical reciprocating movement of the slide to perform press-working on a workpiece.

BACKGROUND ART

A press machine (a so-called electric servo press machine (a press machine); hereinafter, the press machine is also referred to simply as a press) for transmitting rotation of an electric servomotor, which is electronically controlled, to a slide and converting the rotation into vertical reciprocating movement of the slide through an intermediation of a power transmission/conversion mechanism (for example, a crank mechanism) so as to use the vertical reciprocating movement of the slide to perform press-working on a workpiece is known.

For the electric servo press machine as described above, the consideration as follows is required in view of advantages thereof (a free motion is enabled by the servomotor, and a flywheel and a clutch/brake unit provided to a conventional mechanical press may be eliminated at the same time).

Specifically, the conventional mechanical press has a configuration in which a motor (or the flywheel) corresponding to a driving source and a crank shaft may be physically (mechanically) completely separated from each other by a state of switching of the clutch/brake unit.

On the other hand, in view of an advantage that an operating state may be relatively freely controlled by using software, a further reduction in device cost and in size and the like, the electric servo press generally adopts a configuration that does not allow the physical separation between the driving source and an operating part while the servomotor and the crank shaft are constantly placed in a connected state.

In the electric servomotor, it is generally extremely difficult to reliably maintain and ensure a stop state when the electric servomotor is stopped in a controlled state (is placed in a servo-lock state) or to ensure that the electric servomotor is reliably stopped within a predetermined time period in the case where the servomotor should be stopped. Specifically, it is difficult to perfectly prevent runaway of the servomotor or the like.

In particular, in the case where the electric servo press is used in a hand-in-die operation, that is, the electric servo press is stopped for each stroke so that the workpiece is manually introduced and removed for use, if the electric servomotor and hence the slide move when the electric servomotor and the slide should be stopped, there is a fear of bringing about a situation where human physical safety is directly threatened. Therefore, the construction of a more advanced system which may realize a reliable safe stop is demanded.

In Patent Document 1, the electric servo press including a mechanical brake for complementing a servo brake or a dynamic brake or as braking means in place of the servo brake or the dynamic brake is proposed.

According to the electric servo press described in Patent Document 1, the addition of the mechanical brake having a larger braking force than that of the servo brake or the dynamic brake enables a more rapid stop and the maintenance of the stop state so as to prevent unexpected start-up or the like and therefore provide safety.

In the press described in Patent Document 1, however, the mechanical brake is operated for each stop. As a result, friction discs are worn to cause a problem in that the friction discs are required to be regularly replaced.

Further, for preventing the unexpected start-up or the like, the braking force of the mechanical brake is required to be larger than a maximum torque of the servomotor. Thus, the brake is increased in size. Moreover, in consideration of the need of the regular replacement of the friction discs increased in size, there is a fear of an increase in economic, burden.

Moreover, in Patent Document 2, an electric servo press for interrupting power to the servomotor to prevent the unexpected start-up (rotational drive) or the like due to the runaway of the servomotor or the like when an operator intrudes into a predetermined range while the press (the rotation of the motor) is in a stop state is proposed.

The electric servo press described in Patent Document 2 is devised so as to prevent a dangerous state from being brought about due to an erroneous operation, the runaway of the servomotor, or the like by the interruption of the power to the servomotor when a hand of the operator or the like intrudes into a press-working area (specifically, a dangerous area) during a setup operation or the like.

Specifically, the stop state of the electric servo press described in Patent Document 2 is more reliably maintained during the stop state of the press (the rotation of the motor). However, the case where an abrupt stop request is made during the operation of the press so as to immediately stop the press is not taken into consideration. Therefore, if a structure described in Patent Document 2 is directly used for the abrupt stop during the operation of the press, there is a fear in that, for example, the operation due to an inertia force is continued for a while.

Therefore, when the human hand or the like intrudes into the dangerous area during a press operation, there is no guarantee that the slide of the press is reliably stopped before the human hand or the like reaches the dangerous area. Thus, there is a fear that a human is physically harmed in a significant fashion. In particular, in the press including the power transmission/conversion mechanism of the press, which consists of the crank mechanism or the like, there is fear that the press may continue operating for a while due to the inertia force of the slide or the crank even after the power to the servomotor is interrupted to cause the driving force to disappear. Therefore, there is a fear in that the risk of an accident causing injury or death is further increased.

In Patent Document 3, a press machine for determining the occurrence of an abnormality when a difference between a position of a slide detected by a motor shaft-side encoder and that detected by a crank shaft-side encoder is equal to or larger than a set value is proposed.

Further, in Patent Document 4, a runaway monitoring device for a press, which monitors the amount of difference between values detected by a slide-side linear scale, a main gear-side encoder, and a motor shaft-side encoder so as to determine the occurrence of an abnormality is proposed.

It is certain that the abnormality such as a failure of the slide-side, crank shaft-side, or motor shaft-side encoder or the like is one of the factors which lead to the runaway of the servomotor, and therefore, it is effective to detect and address the abnormality to prevent the runaway. However, the runaway of the servomotor occurs not only due to the abnormality described above and may also occur due to, for example, the abnormality of a motion controller computing section of the servomotor or a storage section of motion control or the like. Therefore, there is a fear that the runaway monitoring device described in Patent Document 4 is insufficient as a countermeasure against the case where the human is physically harmed.

In Patent Document 5, a runaway monitoring device for detecting a press speed each time a predetermined period of time elapses after a deceleration stop command signal is input to a servomotor and for actuating mechanical braking when the press speed exceeds a preset speed is proposed.

The runaway monitoring device described in Patent Document 5 monitors a deceleration condition of the servomotor, and may effectively monitor not only the abnormality of the encoder as in the case of Patent Documents 3 and 4 but also the runaway occurring due to the abnormality of the computing section of the motion control, the storage section of the motion control, or the like.

However, the runaway monitoring device described above may determine the occurrence of the abnormality only after detecting that the speed has not been reduced to a preset speed at a time, at which the speed should have been reduced to the predetermined speed if the servomotor operates normally. Only after the determination of the occurrence of the abnormality, the mechanical brake is operated. Thus, the actual braking is started by the mechanical brake to start decelerating the servomotor after a delay corresponding to the sum of a time period required for the detection and a brake actuation time period from the input of a braking start command to the start of the actual braking by the mechanical brake. As a result, a stop time is ultimately delayed by the amount of delay. Moreover, if the servomotor is in a runaway state where the servomotor is driven at an increased speed or the like, the time period required for the braking is further increased. Therefore, the stop of the servomotor, and consequently, the stop of the press machine are further delayed.

Patent Document 1: JP Laid-Open No. 2003-290997 A
Patent Document 2: JP Laid-Open No. 2005-125330 A
Patent Document 3: JP Laid-Open No. 2003-205397 A
Patent Document 4: JP Laid-Open No. 2005-219089 A
Patent Document 5: JP Laid Open No. 2005-199314 A

DISCLOSURE OF THE INVENTION

Problem to be Solved by the Invention

Even in conventional mechanical presses and electric servo presses, an intrusion detection device such as a photoelectric safety device is conventionally used to prevent the accident causing injury or death.

More specifically, the intrusion detection device is installed, for example, before (or outside) the dangerous area. It is ensured that the slide of the press is stopped after the hand or the like passes the intrusion detection device before reaching the dangerous area to prevent the hand or the like from being caught by the slide, a die or the like.

Therefore, the intrusion detection device is installed at a predetermined distance away from the dangerous area. In the case where the hand or the like moves at a speed of 1.6 m/sec, for example, it is required to ensure that the slide of the press is stopped within a time period required for the hand or the like to pass the intrusion detection device to reach the dangerous area.

The fact described above means that, if the time period from the detection of the intrusion to the ensured stop of the slide becomes longer, the intrusion detection device is required to be installed at a correspondingly longer distance away from the dangerous area (the work area), which in turn lowers the operability of the press. In other words, in order to improve the operability of the press, it is required to stop the slide as quickly and reliably as possible upon detection of the intrusion by the intrusion detection device.

A relation between the distance from the dangerous area to the intrusion detection device (specifically, a safe distance) and the time period from the detection to the ensured stop of the slide (a maximum abrupt stop time period) is defined according to, for example, American National Standards (ANSI B11.1), European Standards (EN 691), and Japanese Power Press Mechanical Structure Standards.

As an example, a calculation expression defined in ANSI B11.1 is cited as below.

$$\text{Safe distance } (Ds)=K(Tm+Tr+Tbm)+Dpf$$

K=1.6 m/sec (a speed of the hand);

Tm: the maximum abrupt stop time period (a time period from the input to a control device to the stop);

Tr: an intrusion detection device response time period;

Tbm: an overrun monitoring time period (in case of deterioration of stop performance, a time period required for the detection of the deterioration); and Dpf: a distance added depending on performance of the intrusion detection device.

In the conventional mechanical press, the stop is always made with the braking force of the mechanical brake. Therefore, the wear of a brake lining or the like tends to be increased with the use. Therefore, it is required to provide the overrun monitoring device for monitoring the brake and detecting that the abnormality occurs when the stop time period is increased. Therefore, in the aforementioned calculation expression for the safe distance, the overrun monitoring time period (Tbm) is taken into consideration.

Here, the overrun monitoring time period (Tbm) in the aforementioned calculation expression for the safe distance is a time period required for the overrun monitoring device to detect the increase in the abrupt stop time period due to the deterioration of the brake. In the aforementioned calculation expression for the safe distance, the safe distance is obtained in consideration of the overrun monitoring time period. In other words, the aforementioned calculation expression for the safe distance is based on the idea that a time period, which enables the ensured stop even if the performance deterioration, the failure, or the like occurs, should be obtained as the maximum abrupt stop time period. Such an idea is required to be adopted even for the electric servo press in view of the fact that there is a fear in that the operation of the press may lead to the accident causing injury or death.

The idea for the safe distance as described above is similarly applied to a two-hand push button. Specifically, the stop of the slide of the press is ensured before the hand released from the two-hand push button reaches the dangerous area.

On the other hand, when the electric servo press has a configuration in which the flywheel is not provided, the electric servomotor itself is required to have a torque required for the press working.

Therefore, the servomotor having a driving torque remarkably larger than that of the servomotor used for the conventional mechanical press is required for the electric servo press.

Thus, in the case where the runaway of the servomotor or the like occurs, if the servomotor is attempted to be stopped with the braking force of the mechanical brake as in the case of the conventional mechanical press, the mechanical brake is increased in size because the mechanical brake is required to stop the servomotor over the large driving torque. As a result, there arise fears of an increase in product cost, and consequently, an increase in maintenance cost.

In addition, there is a fear in that the deceleration with the large braking torque may generate relatively large vibrations, noise, or the like in the press machine. Therefore, in view of the generation of the vibrations or noise, the deceleration with the large braking torque is not desirable.

Therefore, an electric servo press, which may immediately stop the slide safely and reliably as in the case of the conventional mechanical press even if the abnormality such as the runaway of the servomotor or the like occurs, is not required to include the large mechanical brake or the like, therefore, does not increase the cost, and is used safely in the hand-in-die operation with good operability and work efficiency, is demanded.

The present invention is devised in view of the above-mentioned circumstances, and has an object of providing an electric servo press having a relatively simple and inexpensive structure, which may be abruptly stopped safely and reliably within a short period of time in response to an abrupt stop command while avoiding a hard operation of a mechanical brake, may be stopped reliably and quickly even in the case where runaway of a servomotor or the like occurs, and provides excellent operability and working efficiency at low cost, and a control device and a control method therefor.

Means for Solving the Problems

When motor runaway due to a failure or an abnormality of a control element or a mechanical element occurs, the motor runaway should be addressed (the press should be stopped) without fail by using the mechanical brake. However, the press is relatively frequently stopped (is stopped at a high probability) in response to an abrupt stop command due to an emergency stop or detection of intrusion, whereas a probability of the occurrence of the motor runaway is extremely low.

Moreover, it is difficult to monitor and detect all the factors which may cause the runaway.

Therefore, an approach is to constantly operate the mechanical brake as a countermeasure against the runaway which has a low probability (frequency of occurrence), but the mechanical brake is actuated for stopping the press based on a command with a higher probability (frequency of generation) according to the approach. Therefore, the approach is disadvantageous in economic and productive aspects.

Moreover, in a control release state (a free motor-rotation state) after the interruption of the power to the motor, a time period required for the servo motor to stop rotating (a rotation attenuating time period) is extremely long as compared with a rotation attenuating time period until the stop of the rotation of the servomotor, which is made by positive rotation stop control for the servomotor. When an emergency stop command or the abrupt stop command is issued in this case, it is desirable to positively perform the rotation stop control for the servomotor in view of the reduction in time period required for the stop.

On the other hand, if the motor runaway actually occurs, the priority should be placed on the human physical safety in comparison with the wear of the brake or the like, and therefore, an economic burden required for the maintenance of the mechanical brake or the replacement of the brake is acceptable. Rather, the amount of wear of the mechanical brake or the like is small for the actuation at the time of the runaway occurring at a low probability. The intervals between the replacements of the friction discs or the like may be sufficiently set long. Thus, it is believed that the economic burden is not increased in actual conditions.

In view of the actual technical conditions specific to the electric servo press described above, according to the present invention, switching to a predetermined motion (for example, a motion for allowing a stop at a maximum acceleration rate without generating large vibrations or noise) is performed upon generation of the abrupt stop command, and the rotation stop control for the motor is performed positively to minimize a time period required to stop the press when the motor operates normally. Further, when a shortest set time period elapses regardless of whether the motor rotation is normal or abnormal and even without determination thereof, the rotation stop control is released to perform the switching to the free motor-rotation state. The mechanical brake is configured to be actually actuated, specifically, to actually perform braking in this state.

Therefore, the present invention provides a method and a device for controlling an electric servo press for converting rotation of an electronically-controlled servomotor through an intermediation of a power transmission/conversion mechanism into vertical reciprocating movement of a slide so as to use the vertical reciprocating movement of the slide to perform press-working on a workpiece, in which:

rotation stop control for the servomotor is executed according to a predetermined abrupt stop motion in response to an abrupt stop command; and a mechanical brake of the electric servo press is caused to actually act to perform braking on an output of the servomotor, and at least one of electronic control including at least the rotation stop control and drive power supply with respect to the servomotor is stopped under a condition that a predetermined time period elapses after start of the execution of the rotation stop control.

In the present invention, a time after elapse of the predetermined time period from the start of the execution of the rotation stop control may be at or around a scheduled stop time at which the rotation of the servomotor is stopped by the execution of the rotation stop control in a case where the servomotor operates normally.

In the present invention, the stop of the at least one of the electronic control including at least the rotation stop control and the drive power supply with respect to the servomotor may include interruption of a control signal line or a drive power supply line connected to the servomotor by means of hardware.

In the present invention, the stop of the drive power supply with respect to the servomotor may include at least one of disappearance of a control signal for power transistors constituting a part of a servomotor drive circuit to cause a base drive signal for the power transistors to disappear and interruption of a driving current supplied to the servomotor by an electromagnetic contactor.

The present invention also provides a control device for an electric servo press for converting rotation of an electronically-controlled servomotor through an intermediation of a power transmission/conversion mechanism into vertical reciprocating movement of a slide so as to use the vertical reciprocating movement of the slide to perform press-working on a workpiece, including:

abrupt stop control means for executing rotation stop control for the servomotor based on an abrupt stop motion stored in storage means upon generation of an abrupt stop command; and control means for instructing a mechanical brake of the electric servo press to start a braking operation on an output of the servomotor at a predetermined brake actuation start timing when the rotation stop control is executed by the abrupt stop control means and for instructing to stop the rotation stop control executed by the abrupt stop control means at a predetermined control release timing.

In the present invention, the predetermined brake actuation start timing may be set to cause the mechanical brake of the electric servo press to actually act to perform braking on the output of the servomotor at or around a scheduled stop time at which the rotation of the servomotor is stopped by the execution of the rotation stop control in a case where the servomotor operates normally.

In the present invention, the predetermined control release timing may be set so that the rotation stop control by the abrupt stop control means is actually stopped at or around a scheduled stop time at which the rotation of the servomotor is stopped by the execution of the rotation stop control in a case where the servomotor operates normally.

In the present invention, the control means may execute control for stopping the drive power supply to the servomotor at or around a scheduled stop time at which the rotation of the servomotor is stopped by the execution of the rotation stop control in a case where the servomotor operates normally.

In the present invention, the stop of the execution of the rotation stop control performed by the abrupt stop control means, the stop being executed by the control means, may include control for interrupting, by means of hardware, a control signal line connected to the servomotor.

In the present invention, the control for stopping the drive power supply to the servomotor, the control being executed by the control means, may include control for interrupting, by means of hardware, a drive power supply line connected to the servomotor.

In the present invention, the control for stopping the drive power supply to the servomotor, the control being executed by the control means, may include at least one of control for causing a control signal for power transistors constituting a part of a servomotor drive circuit to disappear to cause a base drive signal for the power transistors to disappear and control for interrupting a driving current supplied to the servomotor by an electromagnetic contactor.

In the present invention, a time at which the mechanical brake of the electric servo press is caused to actually act to perform braking on the output of the servomotor may coincide with or be a predetermined time earlier than a time at which at least one of electronic control including at least the rotation stop control and drive power supply with respect to the servomotor is stopped.

In the present invention, at least a section for storing the predetermined brake actuation start timing, a section for instructing the mechanical brake of the electric servo press to start a braking operation on the output of the servomotor at the predetermined brake actuation start timing, a section for storing the predetermined control release timing, and a section for instructing the stop of the execution of the rotation stop control performed by the abrupt stop control means at the predetermined control release timing may be configured with redundancy to increase reliability in safety.

In the present invention, the mechanical brake may be structured so that an electromagnetic valve is actuated to exhaust air in a cylinder to release an air pressure against a biasing force of a spring, and so that friction elements are pressed against each other through the biasing force of the spring to perform braking on the output of the servomotor.

In the present invention, a time at which the mechanical brake of the electric servo press is caused to actually act to perform braking on the output of the servomotor may coincide with or be a predetermined time earlier than a time at which at least one of electronic control including at least the rotation stop control and drive power supply with respect to the servomotor is stopped.

In the present invention, the mechanical brake may be structured so that an electromagnetic valve is actuated to exhaust air in a cylinder to release an air pressure against a biasing force of a spring, and so that press friction elements are pressed against each other through the biasing force of the spring to perform braking on the output of the servomotor.

Further, in the present invention, the servomotor may be a synchronous type motor rotationally driven in response to a rotation drive signal, which is synchronous with a position of a magnetic pole of a rotor.

In the present invention, the abrupt stop command may be generated based on at least one of an emergency stop command generated based on a manual operation of an operator and an intrusion detection signal generated based on intrusion of a human hand or the like into a dangerous area.

In the present invention, the scheduled stop time may be a scheduled stop time, at which the rotation of the servomotor is stopped by the execution of the rotation stop control from a state in which the servomotor is being operated at a maximum speed or a state in which the electric servo press is being operated at a maximum speed, regardless of a rotation speed of the servomotor before the execution of the rotation stop control.

Further, in the present invention, the scheduled stop time may be changed according to a rotation speed and a target deceleration rate of the servomotor before the execution of the rotation stop control.

Further, an electric servo press according to the present invention includes the control device for an electric servo press according to the present invention.

Effect of the Invention

According to the present invention, it is possible to provide an electric servo press having a relatively simple and inexpensive structure, which may be abruptly stopped safely and reliably within a short period of time in response to an abrupt stop command while avoiding a hard operation of a mechanical brake, may be stopped reliably and quickly even in the case where runaway of a servomotor or the like occurs, and provides excellent operability and working efficiency at low cost, and a control device and a control device therefor.

DESCRIPTION OF SYMBOLS

Figure 1:
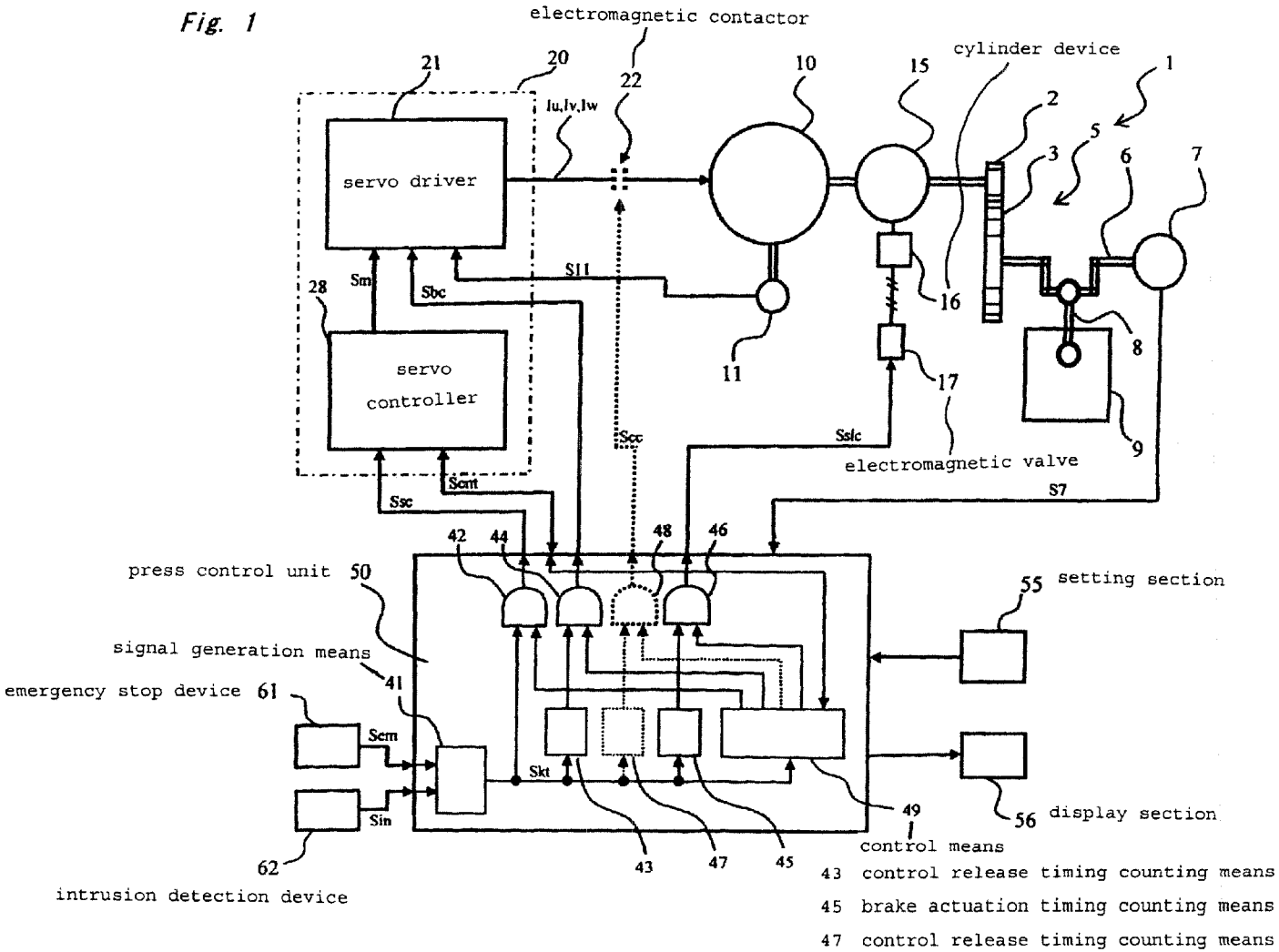
FIG. 1 is a block diagram for illustrating a control device for an electric servomotor according to a first embodiment of the present invention.

1 electric servo press
5 crank mechanism (power transmission/conversion mechanism)
7 crank-shaft encoder
9 slide
10 servomotor
15 mechanical brake
20 servo drive circuit
22 electromagnetic contactor
24 drive circuit
25 power transistor
26 PWM control section
28 servo controller
50 press control unit
52 computing section
53 storage section
55 setting section
56 display section
61 emergency stop device
62 intrusion detection device

BEST MODE FOR CARRYING OUT THE INVENTION

Hereinafter, the best mode for carrying out the present invention is described in detail referring to the drawings. The present invention is not limited by an embodiment described below.

As described below based on FIGS. 1 to 8, an electric servo press 1 according to this embodiment is configured to enable the realization of the following press operation. Based on an abrupt stop command signal Skt, switching to rotation stop control (abrupt stop control) for a servomotor 10 according to a preset abrupt stop motion CRVs is performed. In addition, a mechanical brake 15 is actuated so as to actually start braking at a scheduled control end time (scheduled stop time t3) at which the stop is completed according to the abrupt stop motion when the servomotor operates normally. Moreover, a rotational drive power source for the servomotor 10 is forcibly disconnected at the scheduled control end time (scheduled stop time t3). In this manner, not only for an abrupt stop request in the case where the servomotor 10, a control system therefor, and the like operate normally but also for an abrupt stop request in the case of a runaway due to an abnormality of the servomotor 10, the control system therefor, and the like, the rotation of the servomotor 10 may be reliably and quickly stopped.

In FIG. 1, the electric servo press 1 converts rotation of the servomotor 10 into vertical reciprocating movement of a slide 9 through an intermediation of a power transmission/conversion mechanism 5 so as to use the vertical reciprocating movement of the slide 9 to perform press-working on a workpiece.

As the power transmission/conversion mechanism 5, for example, a crank mechanism 5 configured to include a crank shaft 6, a connecting rod 8, and the like is supposed. A rotating shaft of the servomotor 10 and the crank shaft 6 are connected to each other through an intermediation of the mechanical brake 15 and a speed-reducer mechanism (pinion 2 and main gear 3). The power transmission/conversion mechanism 5 may be implemented by using a screw-shaft mechanism, a link mechanism, or the like.

A motor-shaft encoder 11 is connected to the servomotor 10. The encoder 11 feeds back a detection signal S11 as information corresponding to a motor-shaft rotation angle to a servo driver 21. The detection signal S11 is used as a position feedback signal in a position control system and used as a speed feedback control signal in a speed control system. Further, although not shown, the detection signal S11 is also transmitted to a servo controller 28 and a press control unit 50 so as to be used for motion control and press control.

A crank-shaft encoder 7 is connected to the crank shaft 6. The encoder 7 transmits a detection signal S7 as information corresponding to a crank-shaft rotation angle to the press control unit 50. The detection signal S7 is converted into a position of the slide 9 and a press speed (slide speed) so as to be used for control and display. Further, although not shown, it is also possible to compare the detection signal S11 and the detection signal S7 with each other so as to detect an abnormality of the detection signal of the encoder by using the technique described in Patent Document 3 or 4.

Although any motor whose operating state may be electronically controlled may be used as the servomotor 10, a synchronous type motor (AC servomotor) which may rotate in synchronization with a signal (rotation drive signal Sd illustrated in FIGS. 5 and 6) corresponding to, for example, a magnetic pole (permanent magnet) of the rotor is used in this embodiment. Even if the rotation drive signal Sd is input, the servomotor 10 may not be rotationally driven when the rotation drive signal is not a signal corresponding to the magnetic pole (permanent magnet) (signal fed at a timing enabling the generation of a driving force). Specifically, when the correspondence between the signal and the magnetic pole is lost due to the generation of an abnormality or a failure of a component (circuit, element, or the like) or motor driving currents Iu, Iv, and Iw may not be interrupted due to a failure of any of power transistors 25 or the like, the servomotor 10 may not be driven normally, and therefore, may not rotate normally. Such a characteristic of the synchronous type servomotor provides safety. Even in this regard, the occurrence of a motor runaway state or the like may be prevented in advance.

As illustrated in FIG. 1, the mechanical brake 15 is configured to operate an electromagnetic valve 17 to exhaust air in a cylinder device 16, and then, to actually perform a brake operation (operation for pressing a movable friction disc against a fixed friction disc) by using a clamping force of a spring so as to apply a braking force to the servomotor 10. Although the mechanical brake 15 is not limited to an air-release type mechanical brake as described above, this type is suitable for a press machine which requires a relatively large braking torque. Moreover, the aforementioned type of mechanical brake is frequently used in conventional mechanical presses, and is advantageous in reliability, cost, availability aspects, and the like. The mechanical brake 15 may also be other types of friction brake or a brake using, for example, an electromagnetic force.

Figure 7:
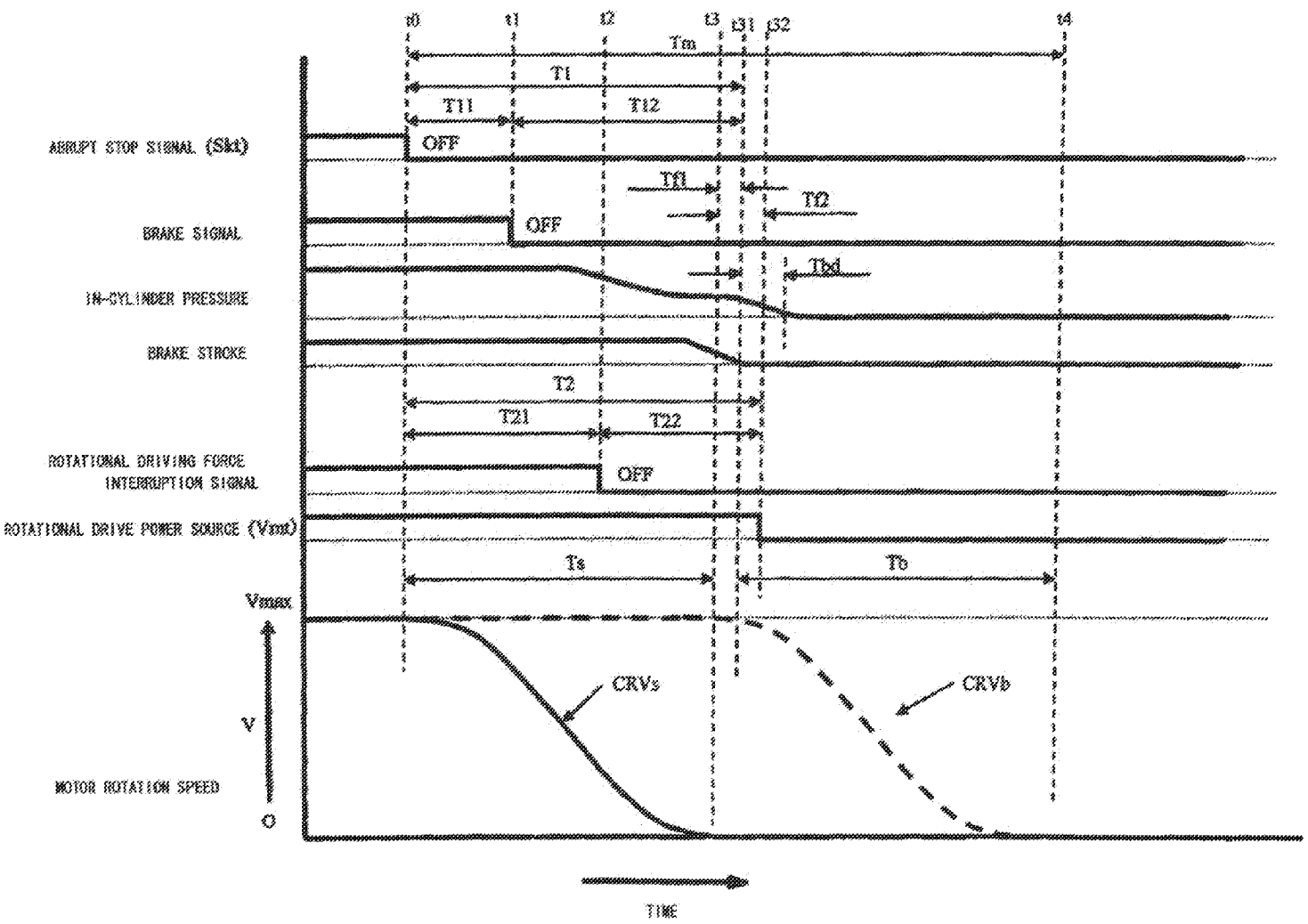
FIG. 7 is a timing chart for illustrating an operation of the control device for the electric servomotor, which is started while the electric servomotor is rotating at a maximum speed, according to the first embodiment of the present invention.

In the mechanical brake 15 according to this embodiment, when the electromagnetic valve (solenoid) 17 is demagnetized at a time t1 as illustrated in FIG. 7, the exhaust of the air in the cylinder device 16 is started through the electromagnetic valve 17. A pressure of the air is gradually lowered with elapse of time. Then, while the friction disc is displacing according to a locus indicated as a "brake stroke" in FIG. 7, the brake operation is started. For convenience of the following description, a time t31 at which the friction discs are brought into contact with each other to enable the brake to start braking is indicated as a substantial start time of the brake operation (actual brake actuation) in FIG. 7.

Specifically, an actuation delay time period of the mechanical brake 15 is T12 (from the time t1 to the time t31), and is, for example, about 60 msec.

After that, when the air in the cylinder device 16 is further exhausted to be substantially completely exhausted, the friction discs are pressed by a full force of the spring. Specifically, the braking force of the mechanical brake 15 increases over a braking force increase time period Tbd (for example, 15 msec) to a defined braking force. The servomotor 10 is braked and stopped with the defined braking force.

As illustrated in FIG. 1, the control device for the electric servo press 1 is configured to include a servo drive circuit 20 and the press control unit 50. Further, the servo drive circuit 20 is configured to include the servo controller 28 and the servo driver 21.

An emergency stop device 61 and an intrusion detection device 62, and in addition, a setting section 55 and a display section 56 are connected to the press control unit 50, whereby the setting of a control release timing, the setting of a braking actuation start timing, in addition, the setting of the abrupt stop motion stored in storage means included in the servo controller 28 in response to a servo control signal Scnt, and the like, which are described below, may be performed. In this embodiment, for example, the servo control signal Scnt is configured to be transmitted and received through a bidirectional serial communication line. The transmission and reception of signals for the setting of motions for various types of press molding and the selection thereof, the selection of an operation mode, the setting and the selection of a servo parameter, and the like are enabled. All the aforementioned signals are included in the servo control signal Scnt.

Specifically, for the setting of the control release timing or the like, a set value is input to the setting section 55 while being confirmed on the display section 56 and is then stored in the storage section as a set value. The setting of the brake actuation start timing, the setting of the abrupt stop motion, and the like may be performed in the same manner.

The press control unit 50 is means for controlling the entire press machine. The operations and components relating to the rotational drive of the servomotor 10, in particular, to the abrupt stop are mainly illustrated in FIGS. 1 and 2, and the illustration of the operations and components which do not directly relate thereto (for example, the contents of control during a normal operation, inputs and outputs which do not relate to the abrupt stop, workpiece conveying means and the like) is herein omitted.

The press control unit 50 is configured to include, for example, an input/output section, a computing section, the storage section, and the like as hardware. However, the illustration of the hardware is omitted in FIG. 1, and sections for performing signal processing for the abrupt stop are mainly illustrated. Upon generation of an abrupt stop signal by the emergency stop device 61 or the intrusion detection device 62, signal generation means 41 included in the press control unit 50 immediately generates an abrupt stop command signal Skt. The abrupt stop signal may also be input not only from the aforementioned devices but also from other devices such as a safety guard as needed.

Upon generation of the abrupt stop command signal Skt (from H-level to L-level), an abrupt stop signal Ssc is transmitted (from H-level to L-level) to the servo controller 28 through an intermediation of logic processing means 42 included in the press control unit 50.

The logic processing means 42 is configured to perform AND processing not only on the abrupt stop command signal Skt but also on the stop command signal generated by another control means 49 (for example, control for the workpiece conveying means and the like) so that an abrupt stop may be made in response thereto. In this manner, the abrupt stop signal Ssc is output (from H-level to L-level) even when any one of the signals is generated (from H-level to L-level). Logic processing means 44, 46, and 48 are provided for achieving the same object.

In the storage means included in the servo controller 28, the abrupt stop motion (more specifically, a motion of the servomotor 10 for making an abrupt stop while rotating at the maximum speed, and is referred to as reference abrupt stop motion) is pre-stored. For the reference abrupt stop motion, a stop curve (stop pattern) suitable for quickly stopping the slide 9 of the electric servo press 1 without generating an excessively large impact, vibration, or the like during the rotation stop control (abrupt stop control) therefor, in other words, a deceleration curve (deceleration pattern) which enables the achievement of a maximum deceleration increasing rate within the range where the impact, vibration, or the like is allowable is set.

The abrupt stop control means includes the press control unit 50, the servo controller 28, and the servo driver 21. Upon reception of the abrupt stop signal Ssc (from H-level to L-level) from the press control unit 50, the servo controller 28 generates the abrupt stop motion for quickly decelerating an operation speed of the servomotor 10 from the operating speed until then to stop the servomotor 10 based on the reference abrupt stop motion by conversion. Simultaneously, the motion during the operation is switched to the abrupt stop motion. A motion signal Sm according to the abrupt stop motion is transmitted to the servo driver 21 so as to perform the rotation stop control for quickly stopping the servomotor 10.

For the abrupt stop motion according to this embodiment, a method of storing only one reference abrupt stop motion when the abrupt stop is to be made while the servomotor 10 is rotating at the maximum speed and computing and generating the abrupt stop motion according to each speed based on the reference abrupt stop motion is used. However, the method is not limited thereto. For example, a method of storing a plurality of abrupt stop motions corresponding to the respective speeds and selecting the abrupt stop motion corresponding to the operation speed or a method of obtaining the abrupt stop motion by an interpolation calculation may be alternatively used.

Brake control means is configured to include the press control unit 50 and the electromagnetic valve 17. A brake actuation start timing set value T11 is preset for brake actuation timing counting means 45 of the press control unit 50 by brake actuation start timing setting means (55, 56, and 50).

Upon generation of the abrupt stop command signal Skt, the brake actuation start timing counting means 45 included in the press control unit 50 starts counting an elapsed time. When a count value reaches the set value T11, a mechanical brake actuation signal Sslc is output (from H-level to L-level) to the electromagnetic valve 17 through the logic processing means 46. The electromagnetic valve 17 is actuated by the brake actuation signal Sslc and exhausts the air in the cylinder device 16 of the mechanical brake 15 so as to start the actuation of the mechanical brake 15.

Forcible control-release means is configured to include the press control unit 50, the servo driver 21 and/or an electromagnetic contactor 22. A control release timing set value T21 is preset for control release timing counting means 43 of the press control unit 50 by control release timing setting means (55, 56, and 50). Upon generation of the abrupt stop command signal Skt, the control release timing counting means 43 starts counting an elapsed time. When a count value reaches the set value T21, a control release signal is output as a base drive interruption signal Sbc (from H-level to L-level) to the servo driver 21 through the logic processing means 44 to interrupt the servomotor driving currents Iu, Iv, and Iw output from the servo driver 21 so as to forcibly release the rotation stop control.

In FIG. 1, the servo drive circuit 20 is configured to include the servo driver 21 and the servo controller 28. The servo controller 28 is configured so as to be able to store the plurality of motions corresponding to various types of press molding, the reference abrupt stop motion, and the like. The servo controller 28 makes a selection from the stored various motions and performs a computation based on the servo control signal Scnt and the abrupt stop signal Scc from the press control unit 50 to generate the motion signal Sm so as to transmit the generated motion signal to the servo driver 21. The servo driver 21 feeds back the position detection signal S11 of the servomotor 10 using the motion signal Sm as a command signal and computes a required driving force to output the motor driving currents Iu, Iv, and Iw corresponding to the computed driving force, thereby rotationally driving the servomotor 10.

Figure 5:
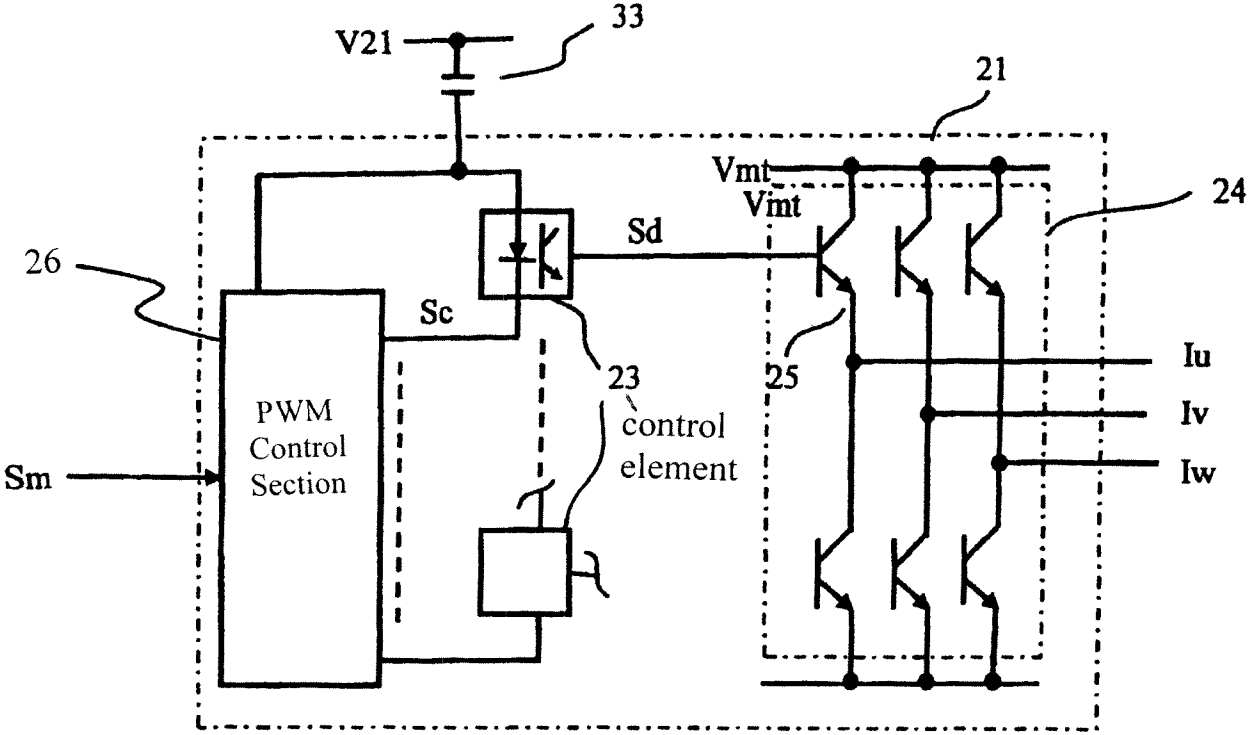
FIG. 5 is a circuit diagram for illustrating a servo driver for the control device for the electric servomotor according to the first embodiment of the present invention.
Figure 6:
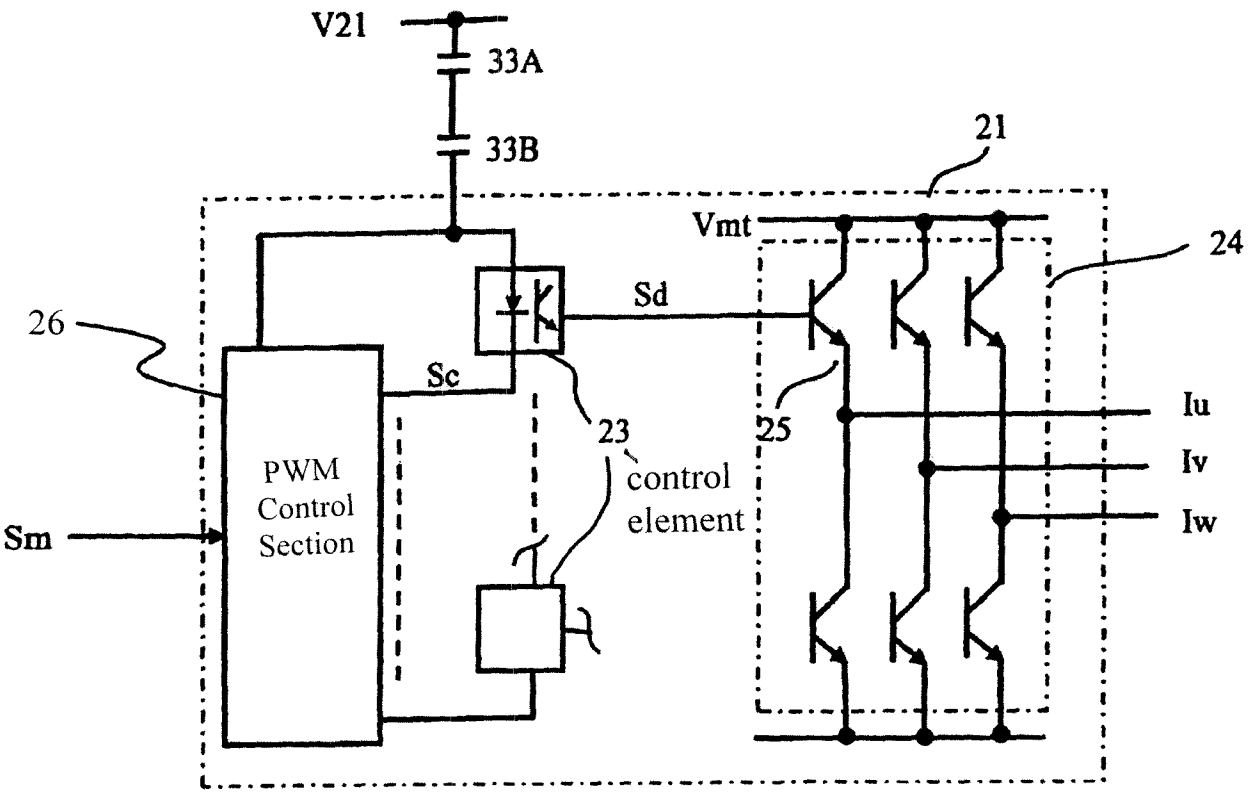
FIG. 6 is a circuit diagram for illustrating the servo driver (with enhanced safety) for the control device for the electric servomotor according to the first embodiment of the present invention.

A PWM control section 26 constituting a part of the servo driver 21 obtains each phase of the servomotor 10 from the position of each magnetic pole based on the position detection signal S11 of the servomotor 10 while adjusting a pulse width based on the required driving force obtained by the computation described above, thereby generating a PWM control signal Sc of each phase, as illustrated in FIG. 5.

The PWM control signal Sc is output to each control element 23 corresponding to each phase of the servomotor 10. Each of the control elements 23 generates and outputs the drive signal Sd corresponding to each phase of the motor to each power transistor 25. Specifically, a drive circuit 24 including the power transistors 25 rotationally drives the servomotor 10. The reference symbols Iu, Iv, and Iw denote the motor driving currents. The details of the connection between windings of the respective phases of the servomotor 10 and the power transistors 25 are known, and hence the illustration thereof is omitted in FIG. 5. The reference symbol V21 denotes a control power source, and the reference symbol Vmt denotes a motor rotational drive power source.

The forcible release of the rotation stop control by the base driving signal interruption is performed in the following manner.

Figure 3:
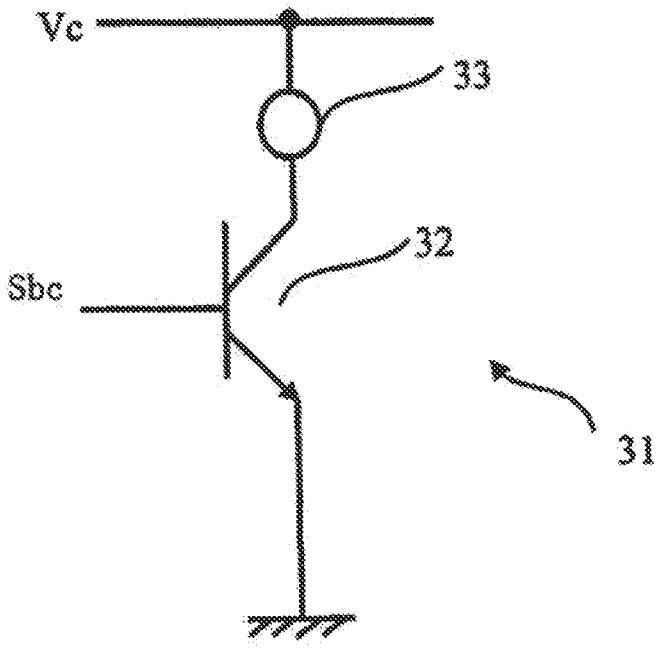
FIG. 3 is a circuit diagram for illustrating disconnection of a rotational drive power source for the control device of the electric servomotor according to the first embodiment of the present invention.

Specifically, upon reception of the base drive interruption signal Sbc (from H-level to L-level) from the press control unit 50 (see FIG. 1 and the like), the servo driver 21 de-energizes a control relay 33 illustrated in FIG. 3 through an intermediation of a drive transistor 32 to open a contact of the control relay 33. As a result, the control power source V21 illustrated in FIG. 5 is disconnected to cause the power to the control elements (base drive elements) 23 to disappear. Specifically, the control signal Sc to the power transistors 25 included in the servo drive circuit 20 is caused to disappear.

As a result, the control elements 23 may not drive the power transistors 25. Thus, the motor driving currents Iu, Iv, and Iw are interrupted to cause the driving force for the servomotor 10 to disappear. Specifically, the servomotor 10 is disconnected from the motor rotational drive power source Vmt to forcibly release the rotation control (rotation stop control for abrupt stop) of the servomotor 10.

As the servomotor 10 according to this embodiment, the synchronous type motor is used, for example. As a result, as described above, the driving force may not be generated unless the PWM control signal of each phase is driven in the phase corresponding to the position of each magnetic pole. Specifically, it is hardly believed that a signal corresponding to the phase is naturally generated if only the PWM control signal Sc is interrupted.

Therefore, even if the motor driving currents Iu, Iv, and Iw may not be interrupted due to the failure or the like, the rotational driving force for the servomotor 10 may not be generated. Specifically, the use of the synchronous type motor as described above provides safety.

Besides the interruption of the base drive signal to the servo driver 21, there is a method of, for example, directly interrupting a motor circuit to the servomotor 10 by the electromagnetic contactor 22 as the forcible control-release means. Portions (47, 48, and 22) indicated with a dot line of FIG. 1 correspond thereto.

Similarly to the method using the base drive interruption, a control release timing set value T21−1 is preset even in this method. Upon generation of the abrupt stop command signal Skt, the control release timing counting means 47 starts counting an elapsed time. When a count value reaches the set value T21−1, an electromagnetic contactor interruption signal Scc is output through the logical processing means 48. As a result, the electromagnetic contactor 22 interrupts the driving currents Iu, Iv, and Iw to forcibly release the rotation stop control.

As described above, when the abrupt stop command signal Skt is generated from the signal generation means 41, the rotation stop control is started so as to quickly stop the servomotor 10.

At the same time, the actuation of the mechanical brake 15 is started at the timing set by the brake actuation start timing setting means (55, 56, and 50), and the rotation stop control for the servomotor 10 is forcibly released at the timing set by the control release timing setting means (55, 56, and 50).

An example of the actuation timings described above is illustrated in FIG. 7.

Here, only the method of interrupting the base drive is described as the means of forcibly releasing the rotation stop control, and the method of interrupting the power by the electromagnetic contactor 22 is omitted. Both methods are for forcibly releasing the rotation stop control and should be set based on the same idea. If the aforementioned forcible control-release means are respectively constituted by sufficiently reliable circuits, only any one or both thereof may be used.

The intrusion detection device 62 is a safety device. If the electric servo press 1 may not be stopped due to some failure or the like even when the intrusion of a human hand or the like is detected, there is a fear that such a case may directly lead to an accident causing injury or death. In general, it is difficult to perfectly prevent the occurrence of an abnormality in the rotational drive control or the rotation stop control (specifically, the runaway of the servomotor 10).

Therefore, it is important to reliably operate the brake control means and the forcible control-release means to stop the servomotor 10.

More specifically, an idea of actuating the mechanical brake 15 by the brake control means while causing the driving force of the servomotor 10 to disappear by the forcible control-release means to reliably prevent the occurrence of the abnormality in the rotational drive control or the rotation stop control (specifically, the runaway of the servomotor 10) so as to reliably stop the servomotor 10 is realized in this embodiment.

Figure 2:
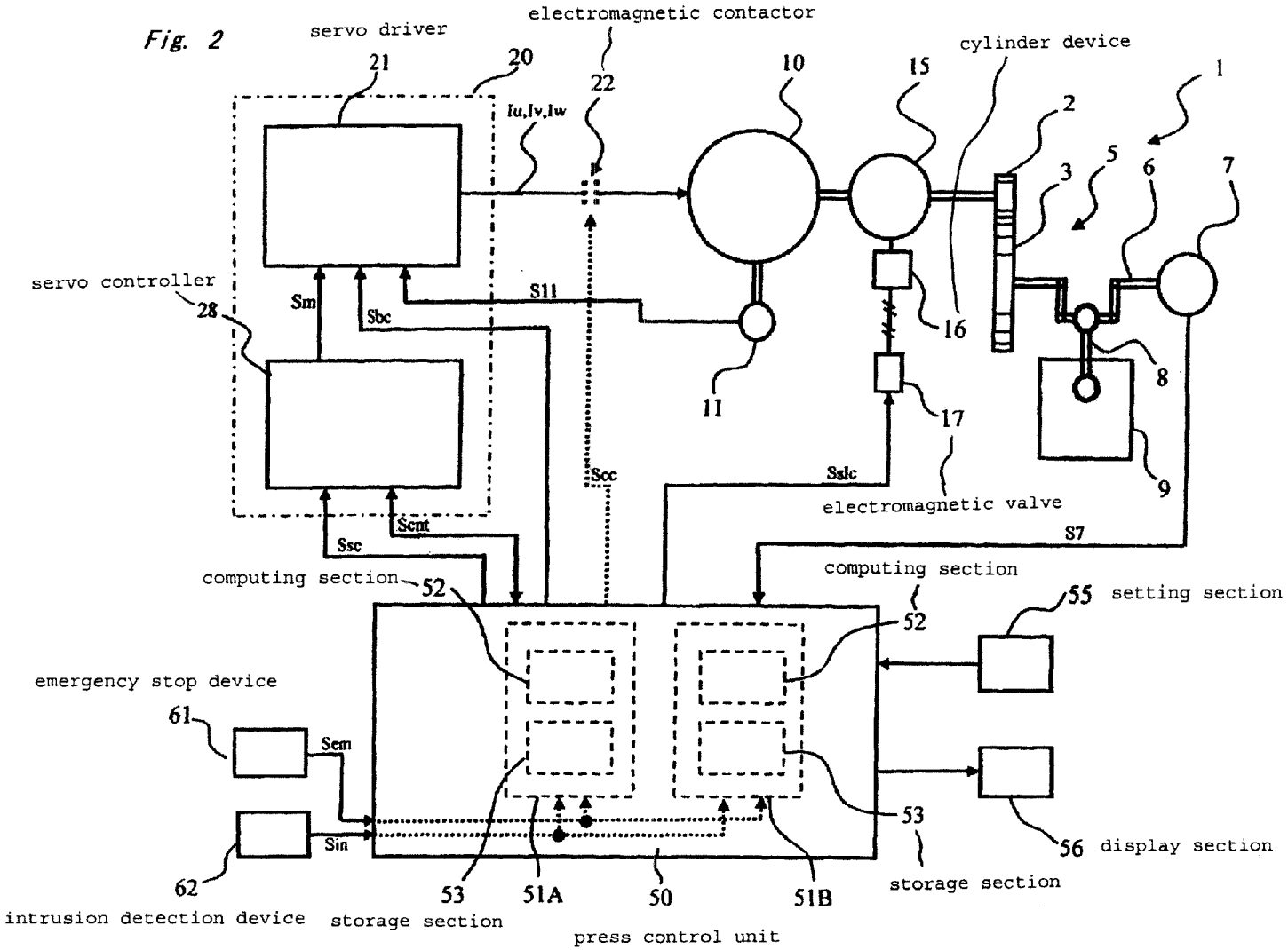
FIG. 2 is a block diagram for illustrating the control device (with enhanced safety) for the electric servomotor according to the first embodiment of the present invention.

For higher reliability in safety, the press control unit 50 may be configured to include two controllers 51A and 51B as illustrated in FIG. 2. Each of the first controller 51A and the second controller 51B includes a computing section 52 and a storage section 53. The aforementioned processing series performed in the press control unit 50 illustrated in FIG. 1 is executed in the controllers 51A and 51B in parallel. The results of the parallel processing are configured to be compared with each other so that consistent information is treated (stored, displayed, output, and the like) as formal information. Although the illustration of the signal processing at the time of generation of the abrupt stop command signal as illustrated inside the press control unit 50 in FIG. 1 is omitted in FIG. 2, the processing described above is actually executed in the first controller 51A and the second controller 51B in parallel.

Figure 4:
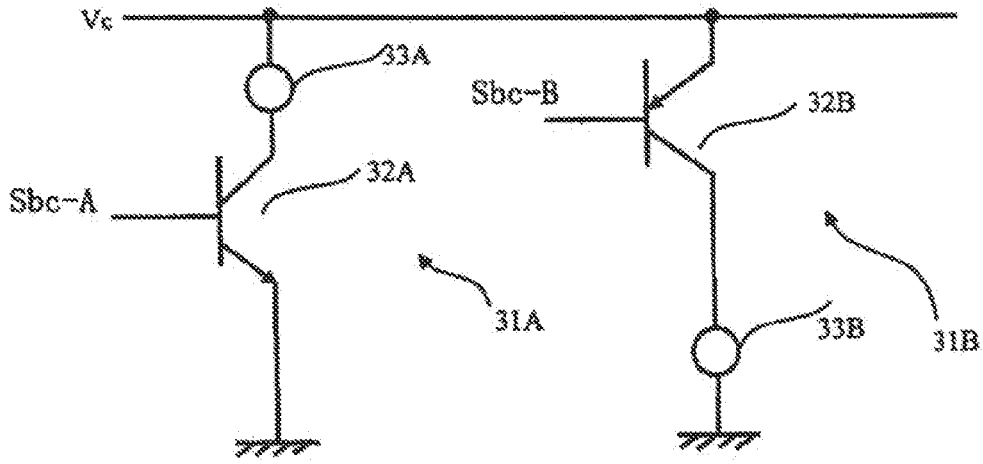
FIG. 4 is a circuit diagram for illustrating the disconnection of the rotational drive power source (with enhanced safety) for the control device of the electric servomotor according to the first embodiment of the present invention.

The output signal from the press control unit 50, such as, for example, the base driving current interruption signal Sbc and the brake actuation signal Sslc is output as a plurality of signals. As illustrated in FIG. 4, output signals in two systems Sbc-A and Sbc-B are used as the base driving current interruption signal, and de-energize the control relays 33A and 33B respectively through the drive transistors 32A and 32B to cause the power to the control elements (base drive elements) 23 illustrated in FIG. 6 to disappear. The aforementioned configuration is a configuration of a so-called safety relay. It is ensured that the base drive power is caused to disappear to interrupt the PWM control signal Sc so as to interrupt the motor driving currents Iu, Iv, and Iw, thereby causing the driving force for the servomotor 10 to disappear.

The control relay 33A is connected to an ungrounded side, whereas the control relay 33B is connected to a grounded side in FIG. 4. This is for preventing the two circuits from simultaneously failing due to the same factor or the like, and is a general way of use in the safety relay. A failure detection circuit for each of the control relays 33A and 33B is known as the safety relay, and hence the illustration thereof is herein omitted.

Further, similarly to the base driving current interruption signal, the output signals in two systems may be used for the brake actuation signal. Although not shown, a double-solenoid valve may be used as the electromagnetic valve (solenoid) 17. Specifically, the mechanical brake 15 may be reliably actuated with high reliability even when the electromagnetic valve fails or the like as a configuration in which, even the electromagnetic valve of one of the systems fails, the air may be exhausted by the electromagnetic valve of the other system. A mechanism for using two-system brake actuation output signals from the press control unit 50 to drive the solenoids by the respective outputs may also be employed.

Moreover, the electromagnetic contactor 22 for interrupting power to the servomotor 10 may also be configured to use two-system outputs and two electromagnetic contactors. However, when it is expected that the driving force for the servomotor 10 may be reliably caused to disappear by the interruption of the base drive signal, the electromagnetic contactor 22 may be omitted.

Although not shown, the intrusion detection device 62 which is important in view of the safety may also have a circuit configuration with redundancy. The configuration may be such that two-system outputs of the intrusion detection device are input to the press control unit 50.

The intrusion detection device 62 may be configured based on, for example, a photoelectric safety device or a safety guard with interlock, which has wide adaptability for human physical protection.

In this embodiment, the photoelectric safety device which is non-contact and has a high detection sensitivity is used. The photoelectric safety device is not required to be opened and closed as in the case of the safety guard, and therefore, may provide a press operation with good operability. However, the photoelectric safety device has the configuration in which the human hand or the like may intrude at any time, and hence the reliable stop of the slide is absolutely imperative.

Here, a ray-scanning position of the photoelectric safety device is a position selected to completely stop the servomotor 10, specifically, stop the electric servo press 1 (slide 9) before the human hand or the like advancing (moving) at a speed of 1.6 m/sec, which is based on the standards, reaches a dangerous area.

Specifically, a distance between the dangerous area of the electric servo press 1 and the ray-scanning position, that is, a safe distance (Ds) is determined by the following expression, and is required to be provided based on the determination.

Hereinafter, a case based on American National Standards (ANSI) is described. Although slight differences exist between countries, fundamental ideas are the same.

$$\text{Safe distance } (Ds)=K(Tm+Tr+Tbm)+Dpf$$

K=1.6 m/sec (moving speed of the hand or the like);

Tm: maximum abrupt stop time period (time period from the input to a control device to the stop);

Tr: intrusion detection device response time period;

Tbm: overrun monitoring time period (in case of deterioration of stop performance, time period required for the detection of the deterioration); and Dpf: distance added depending on performance of the intrusion detection device (which depends on the size of the smallest object to be detected).

Herein, Tm is the maximum abrupt stop time period illustrated in FIG. 7, and Tr and Dpf are determined based on the performance of the photoelectric safety device. The time period Tbm is generated due to an overrun monitoring device used in the conventional mechanical press.

It is believed that the mechanical brake is hardly deteriorated in the electric servo press 1 according to the present invention, and hence it is considered that the consideration thereof may be omitted.

The signal generation means 41 included in the press control unit 50 is configured so as to be able to generate a command (abrupt stop command signal Skt) for abruptly stopping the electronic servo press 1 (servomotor 10, and consequently, slide 9) on the condition that any one of an emergency stop command signal Sem and an intrusion detection signal Sin (or both thereof) is (are) input.

For example, in the case where there is a fear in that the workpiece falling from the workpiece conveying means and the slide 9 moving up and down may interfere with each other, the emergency stop signal Sem is generated and output when the operator or the like operates (pushes) the emergency stop button 61.

When detecting the human hand or the like moving toward the dangerous area, the intrusion detection device 62 generates and outputs the intrusion detection signal Sin.

The examinations conducted by the inventor of the present invention and others in the press operation (hand-in-die operation) for manually feeding the material (workpiece) show that the frequency of generation of the latter (signal Sin) is higher than that of the generation of the former (signal Sem).

When the abrupt stop command signal Skt is generated in response to the emergency stop command signal Sem or the intrusion detection signal Sin and is then input to the signal generation means 41, the abrupt stop control means (50, 28, and 21) functions to send the abrupt stop signal Ssc from the press control unit 50.

The servo controller 28 having received the abrupt stop signal Ssc generates an abrupt stop motion based on the reference abrupt stop motion stored therein so as to transmit the motion signal Sm according to the generated motion to the servo driver 21.

The servomotor 10 driven by the servo driver 21 starts the deceleration/stop control at a time t0 as a start point and, as illustrated in FIG. 7, decelerates according to the abrupt stop motion CRVs (deceleration curve (deceleration pattern) in the case where the abrupt stop is to be made while the servomotor is rotating at the maximum speed). In the case where the servomotor 10 is controlled normally (as in the most of general cases), the servomotor 10 is completely stopped after elapse of a scheduled stop time period Ts (for example, 70 msec), that is, at a scheduled stop time t3. For comparison, when the servomotor driving current (rotational drive power source Vmt) is interrupted at the time t0 to place the servomotor 10 in a free rotation state, the rotation continues over a considerably longer time (for example, several seconds). In particular, when the power transmission/conversion mechanism 5 is the crank mechanism, the inertia thereof is large. Therefore, there is a fear in that the rotation continues for a much longer period of time.

In the case where the intrusion detection device 62 is the photoelectric safety device, there is a delay time period (intrusion detection device response time period Tr) from a time at which a ray is blocked to the actual output of the detection signal in reality. However, the illustration thereof is omitted in FIG. 7. Moreover, although some other types of intrusion detection device similarly have the delay time period, the delay time period may be treated in the same manner.

On the other hand, the mechanical brake 15 has an actuation delay time period T12 (from t1 to t31: operation time period of the electromagnetic valve 17 or time period for exhausting the air in the cylinder device 16). As illustrated in FIG. 7, the timing set value T11 for outputting the brake actuation signal Sslc is set so that the mechanical brake 15 actually starts braking at the scheduled stop time t3 in consideration of the actuation delay time period T12.

More specifically, the timing set value T11 is set so that the scheduled stop time t3 according to the abrupt stop motion CRVs and the braking start time t31 substantially coincide with each other. However, the scheduled stop time t3 and the braking start time t31 are not required to perfectly coincide with each other, as described below.

For this reason, a timing adjustment time period Tf1 (for example, 10 msec) is provided in FIG. 7.

Therefore, the timing set value T11 for outputting the brake actuation signal Sslc is obtained by:

$$T11=Ts-T12+Tf1.$$

As a specific example of the time periods, for example,

T11 (20 msec)=Ts (70 msec)−T12 (60 msec)+Tf1 (10 msec) is supposed.

The forcible control-release means also has a delay time period T22 (from t2 to t32: delay time period from the output of the control release signal to the disappearance of the driving force due to the actuation time period of the control relay 33 or the electromagnetic contactor 22 or a delay time period in the circuit actuation) from the output of the control release signal (Sbc and/or Scc) to the disappearance of the driving force for the servomotor 10.

Therefore, the control release timing set value T21 (and/or T21−1; hereinafter, T21 is representatively used for the description) is set as in the case of the actual actuation start timing of the mechanical brake 15.

Specifically, the output timing set value T21 for the control release signal (Sbc and/or Scc) is set so that the driving force for the servomotor 10 actually disappears in synchronization with the scheduled stop time t3 according to the abrupt stop motion CRVs. More specifically, the set value T21 is set so that the scheduled stop time t3 according to the abrupt stop motion CRVs and a driving force disappearance time t32 substantially coincide with each other. However, the time t3 and the time t32 are not required to perfectly coincide with each other, as described below.

For this reason, a timing adjustment time period Tf2 (for example, 20 msec) is provided in FIG. 7. Therefore, the timing set value T21 for outputting the control release signal (Sbc and/or Scc) is obtained by:

$$T21=Ts-T22+Tf2.$$

As a specific example of the time periods, for example,

T21 (60 msec)=Ts (70 msec)−T22 (30 msec)+Tf2 (20 msec) is supposed.

Although the timing adjustment time periods Tf1 and Tf2 are provided in the timing chart illustrated in FIG. 7, it is ideally desirable that the scheduled stop time t3, the braking start time t31, and the driving force disappearance time t32 coincide with each other.

For a practical operation, however, the actual brake actuation start or motor stop is not always performed as scheduled due to, for example, the effects of a disturbance such as a fluctuation in power supply voltage. In addition, requiring strict precision of each timing setting operation performed by the operator is not practical in view of the operation efficiency or the like. For the aforementioned reasons, the timing adjustment time periods Tf1 and Tf2 are provided so as to absorb a variation due to the effects of the disturbance and the like to make the operation efficiency and the like practical. However, if the timing adjustment time periods Tf1 and Tf2 are set too long, the maximum abrupt stop time period Tm becomes correspondingly longer although slightly. Therefore, it is desirable to set the timing adjustment time periods Tf1 and Tf2 in consideration of the practicality of the effects of the disturbance, the operation efficiency, or the like, and the safe distance for installing the intrusion detection device 2, based on the comparison therebetween.

On the other hand, the braking start time t31 may be set so that the braking is started by the brake shortly before the scheduled stop time t3 without providing the timing adjustment time period (so that the timing adjustment time period Tf1 is set to a negative value). Even shortly before the scheduled stop time t3, the deceleration is sufficient if the control for the servomotor 10 is performed normally. Therefore, it is sufficient to perform only a small amount of braking on the servomotor 10 which is about to stop and is rotating at a low speed with a small torque. Moreover, the exhaust of the air is insufficient and the pressing force of the friction discs is small at the start of the braking for the mechanical brake 15, and hence the friction discs are scarcely worn. Rather, by setting the braking start time t31 shortly before the scheduled stop time t3 as described above, it is expected that the friction discs may be constantly kept clean owing to the generation of small sliding movement between the friction discs even during the normal operation.

As described above, a lap state where the timing adjustment time periods Tf1 and Tf2 are set to negative values is also possible, and the timing adjustment time periods Tf1 and Tf2 are allowable to be, for example, about ±20% of the maximum abrupt stop time period Tm. However, if the driving force disappearance time t32 is set before the braking start time t31 (Tf1>Tf2), the driving force for the servomotor 10 disappears before the mechanical brake 15 actually starts braking. Therefore, a time period during which the rotation shaft of the servomotor 10 becomes free is generated. As a result, there is a fear in that the slide 9 falls under its own weight. Therefore, it is desirable to appropriately set the timing adjustment time periods Tf1 and Tf2 after trials and the like.

The free state of the rotation shaft is allowed only for an extremely short time period which does not cause the slide 9 to actually fall down under its own weight. Specifically, the allowable time period is up to about 10 msec for a small-sized press machine and up to about 30 msec for a large-sized press machine.

As described above, it is desirable that the time at which the actuation of the mechanical brake 15 is actually started (braking is started) and the time at which the rotation stop control is forcibly released coincide with the scheduled stop time t3. In practice, however, the aforementioned times are allowed to be around the scheduled stop time t3. Such setting is encompassed in this embodiment.

Figure 8:
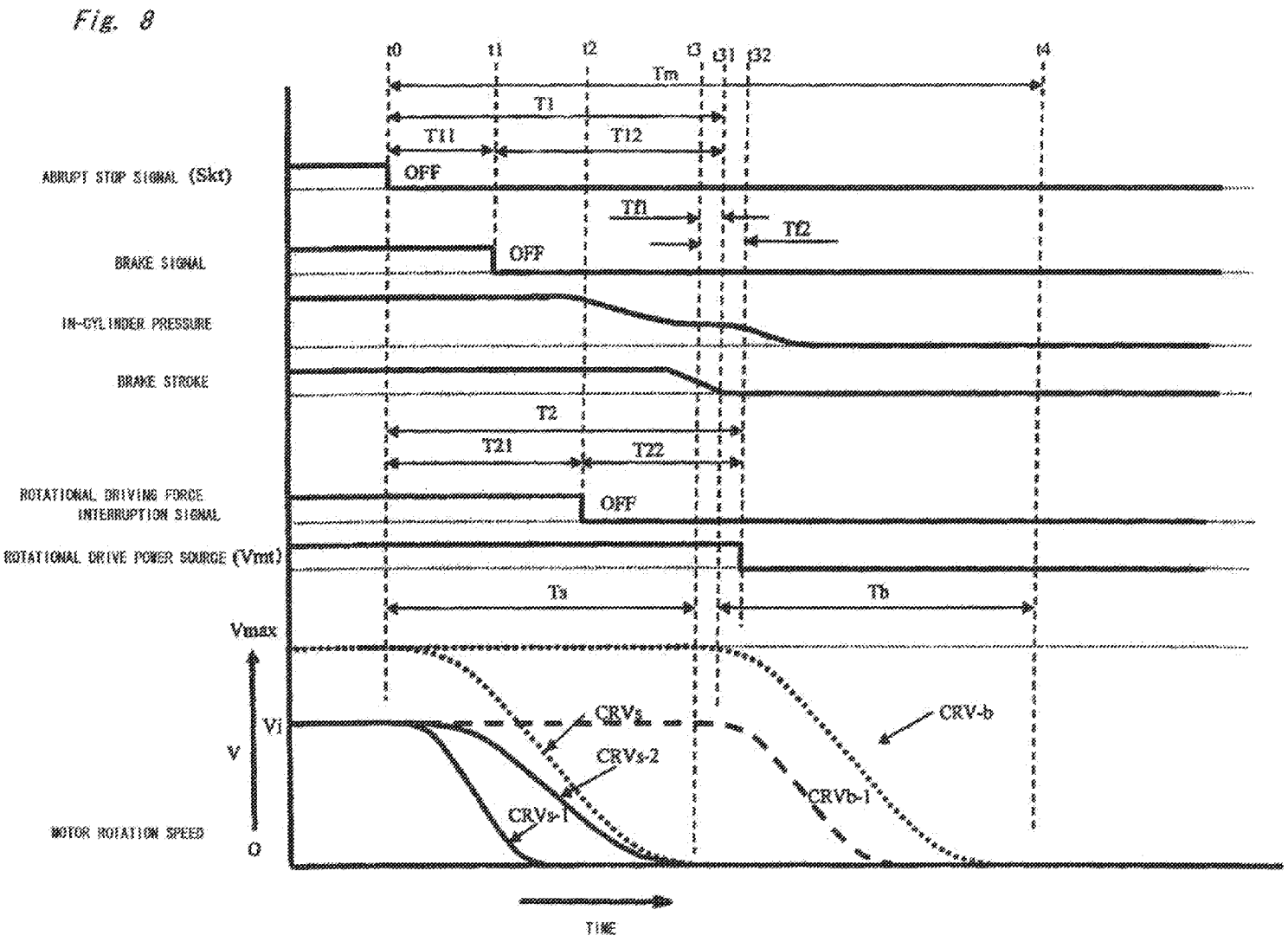
FIG. 8 is a timing chart for illustrating the operation of the control device for the electric servomotor, which is started while the electric servomotor is rotating at a medium speed, according to the first embodiment of the present invention.

In this embodiment, the timing adjustment time period Tf1 is set to 10 msec, whereas the timing adjustment time period Tf2 is set to 20 msec, as illustrated in FIGS. 7 and 8. Therefore, in the case where there is no abnormality in the control for the servomotor 10, the mechanical brake 15 actually starts braking 10 msec after the scheduled stop time t3 at which the servomotor 10 is stopped normally. Then, 10 msec after the start of the braking by the mechanical brake 15, the rotation stop control is forcibly released.

Therefore, in the case of the setting as described above, the maximum abrupt stop time period Tm is increased by the timing adjustment time periods. However, the sliding movement of the friction discs of the mechanical brake 15 does not occur at all. In addition, the driving control for the servomotor 10 is stopped while the mechanical brake 15 is actually braking the servomotor 10, and hence the free rotation state does not take place at all. Thus, the abrupt stop control for the servomotor 10, and therefore, the electric servo press 1 with the ensured prevention of the occurrence of unexpected rotation of the servomotor 10 or the like may be realized while the wear of the friction discs of the mechanical brake 15 or the like is minimized.

In general, the press machine is not always operated at the maximum speed. The speed during a manufacturing operation is appropriately determined in terms of processing conditions and a conveying device.

FIG. 7 illustrates the abrupt stop which is made during the operation at the maximum speed, whereas FIG. 8 illustrates a stop condition during the operation at a medium speed Vi.

Upon reception of the abrupt stop signal, the servo controller 28 computes and generates the abrupt stop motion according to the operation speed at that time. An abrupt stop motion CRVs-1 illustrated in FIG. 8 is calculated so that the rotation is stopped at the same acceleration rate as that of the abrupt stop motion CRVs for the rotation at a maximum speed Vmax.

On the other hand, an abrupt stop motion CRVs-2 is calculated so that the rotation is stopped at the same time as the time at which the rotation is stopped with the abrupt stop motion CRVs.

As described above, as the abrupt stop motion at the medium speed, any of the motions or a motion therebetween may be used as long as the rotation may be stopped within the scheduled stop time period Ts. In this embodiment, the case where the motion CRVs-1 with the same acceleration rate is used is described.

In a conventional mechanical press machine, upon determination of the press speed (spm: stroke per minute), the speed of the slide (or crank shaft) of the press is determined. On the other hand, the electric servo press machine may set various motions suitable for various types of molding and realize the operation thereof. For example, during one stroke of the slide, a motion, in which the slide is moved down at a high speed to reach a processing area, performs subsequent molding at the speed switched to low, and is moved up at the high speed after the termination of the molding so as to return to a set point, is frequently used. Such a motion allows slow molding so as to maintain product accuracy to a predetermined level in the case where the molding is relatively difficult or the like, thereby improving the productivity at the same time.

On the other hand, the motion as described above may be easily used in the electric servo press, and hence the possibility of actual use of the motion is also high. Therefore, it is necessary to assume the case where the abrupt stop motion is computed and generated from the speed of the servomotor at the time when the abrupt stop command signal is generated.

Accordingly, the aforementioned method is used even in this embodiment. However, in the case where only the motions with a relatively small change in speed are to be set, it is also possible to compute and generate the abrupt stop motion from the press speed (spm) as in the case of the conventional mechanical press machines.

When the abrupt stop motion CRVs-1 in the case of the rotation at the medium speed Vi is used, the actual scheduled stop time period is reduced than that at the maximum speed. Therefore, it is also possible to perform an automatic calculation to reduce each of the set values T11 and T12 by a corresponding amount. In this manner, the braking start time t31 and the driving force disappearance time t32 may be put forward to reduce the maximum abrupt stop time period Tm. However, the position of installation of the intrusion detection device 62 is not normally changed according to the operation speed. Therefore, in this embodiment, the braking start time t31 and the driving force disappearance time t32 are fixed, as illustrated in FIG. 8.

The detailed description is given according to a timing chart of FIG. 8.

The brake control means includes the press control unit 50 and controls the mechanical brake 15 to actually start braking at an end of a preset brake operation timing T1, that is, at the time t31.

The forcible control-release means is configured to include the press control unit 50 and the servo drive circuit 20 (may also include the electromagnetic contactor 22), and forcibly releases the rotation stop control at an end of a preset control release timing T2, that is, at the time t32.

As a result, regardless of whether or not the rotation stop control based on the abrupt stop command signal Skt is terminated at the time t3 illustrated in FIG. 8, the stop operation is performed by the mechanical brake 15 at the time t31 without fail. In addition, at the time t32, the rotation stop control for the servomotor 10 is forcibly released.

As described above, when the intrusion detection device 62 is actuated to generate the abrupt stop command signal Skt, the rotation of the servomotor is stopped within the scheduled stop time period Ts in the case where the servomotor 10 and the servo driver circuit 20 operate normally. The servomotor and the servo driver circuit operate normally in most of the cases, and hence the mechanical brake 15, which starts braking after (or immediately before) the scheduled stop time t3, is actuated after the stop of the rotation of the servomotor. Therefore, the wear of the friction discs or the like scarcely occurs. Further, the mechanical brake 15 may function as a stop-maintaining brake at the time t32 at which the driving force to the servomotor 10 disappears and from then on.

In the case of the normal operation, safety is provided because the rotation may be stopped within a considerably shorter time period than the maximum abrupt stop time period Tm.

On the other hand, if the servomotor 10 may not be stopped at the scheduled stop time t3 due to the runaway thereof or the like, the mechanical brake 15 starts braking at the braking start time t31. At the driving disappearance time t32, the driving force for the servomotor 10 disappears. Therefore, the servomotor 10 may reliably stop the servo motor 10 with the defined braking force of the mechanical brake 15 according to the brake deceleration curve CRV-b illustrated in FIG. 8 within a brake stop time period Tb (for example, 70 msec).

Therefore, even in the case where the runaway of the servomotor 10 or the like occurs, the reliable stop of the servomotor 10 within the maximum abrupt stop time period Tm is guaranteed, thereby ensuring the safety. Moreover, the runaway of the servomotor 10 or the like does not frequently occur, and hence the amount of wear of the mechanical brake 15 is not so large. Thus, an expensive large-capacity brake device with high durability is not required, and hence an economic advantage is provided.

In comparison between the cases where servomotor 10 operates normally and the cases of occurrence of abnormalities/failures (runaway) thereof in the abrupt stop control, the number of the cases where the servomotor 10 operates normally is overwhelmingly larger in terms of probability as described above. In addition, when the press (motor rotation) speed before the abrupt stop control is lower than the maximum speed Vmax as described above and the servomotor operates normally with no abnormality occurring in the components, the servomotor 10 may be completely stopped within a time period shorter than the time period T1 (for example, 70 msec) which is set so as to completely stop the servomotor 10 rotating at the maximum speed. Even in this regard, according to the abrupt stop control of this embodiment, a lifetime of the mechanical brake 15 may be prolonged.

The rotation stop control (abrupt stop control) according to this embodiment places emphasis on the actual press operation (primary case). In the abrupt stop control in the case where the servomotor 10 operates normally, the servomotor 10 may be reliably stopped within a short time period while the wear of the friction discs of the mechanical brake 15 is minimized. In the case of the motor runaway (secondary case) occurring at a low probability, the rotation stop control for the servomotor 10 is forcibly released (the interruption of the supply of the drive power may also be performed) at the scheduled stop time while the servomotor 10 is braked by the mechanical brake 15. In this manner, even if the runaway of the servomotor 10 or the like is occurring, the stop of the rotation of the servomotor 10 within the maximum stop time period may be ensured. As a result, the rotation stop control is constructed so as to ensure the human physical safety.

Next, a method of operating the press and each operation are described referring mainly to FIGS. 7 and 8.

FIG. 7 illustrates an operation timing for the abrupt stop made when the press is operated at the maximum speed Vmax. FIG. 8 also illustrates the case of the middle speed Vi (about a ⅔ speed of the maximum speed Vmax).

[Before the Time t0]

The servo control signal Scnt is output as a normal operation signal (press operation signal) from the press control unit 50 to the servo drive circuit 20. The servomotor 10 is controlled to be rotated at a predetermined speed (V) according to the motion selected to correspond to the servo control signal Scnt. At this time, the slide 9 is moved up and down to perform press working.

At this time, the motor is rotated at various speeds according to the needs, such as the maximum speed Vmax in view of the productivity (FIG. 7) or the medium speed (for example, ⅔×Vmax) for, for example, special processing (for example, deep drawing) (FIG. 8).

[At the Time T0]

At the time t0, upon generation of the emergency stop signal Sem by the operation of the emergency stop button 61 illustrated in FIG. 1 or upon generation of the intrusion detection signal Sin by the intrusion detection device 62, the abrupt stop command signal Skt is immediately generated from the signal generation means 41. Then, the press control unit 50 outputs the abrupt stop signal Ssc (from H to L) to the servo controller 28.

Upon reception of the abrupt stop signal Ssc (from H-level to L-level) from the press control unit 50, the servo controller 28 generates, by conversion, the abrupt stop motion (CRVs for Vmax illustrated in FIG. 7 and CRVs-1 for Vi illustrated in FIG. 8) for allowing the rotation to be quickly decelerated to be stopped from the speed of the operation of the servomotor 10 until then (maximum speed Vmax in the case of FIG. 7 and medium speed Vi in the case of FIG. 8) based on the reference abrupt stop motion. Simultaneously, the motion during the operation is switched to the abrupt stop motion. The motion signal Sm according to the abrupt stop motion is transmitted to the servo driver 21 to perform the rotation stop control so as to quickly stop the servomotor 10.

The abrupt stop motion generated by the servo controller 28 is a command value for the servomotor 10. The servomotor 10 is controlled so as to actually follow the abrupt stop motion. A difference is generated between the motion, according to which the servomotor 10 is subjected to the rotation stop control to actually operate, and the command value. Therefore, the actual motion is different from the command value in a strict sense. In reality, however, the difference is small. Therefore, both the motions are similarly treated as the abrupt stop motion (CRVs for Vmax illustrated in FIG. 7 and CRVs-1 for Vi illustrated in FIG. 8). Specifically, the abrupt stop motions CRVs and CRVs-1 are both the abrupt stop motions as the command values and the abrupt stop motions according to which the servomotor 10 is actually decelerated to be stopped.

More specifically, the servo driver 21 generates and outputs the control signal Sc according to the motion signal Sm from the servo controller 28. Each of the control elements 23 outputs the drive signal Sd corresponding to the magnetic pole of the motor to the drive circuit 24. As a result, the motor driving currents I (Iu, Iv, and Iw) are generated to quickly decelerate and stop the servomotor 10.

When the control system and the servomotor 10 operate normally, the rotation of the servomotor is stopped at the scheduled stop time t3 in the case of the rotation at the maximum speed Vmax (FIG. 7) and is stopped before the scheduled stop time t3 in the case of the rotation at the medium speed Vi (FIG. 8).

Simultaneously with the generation of the abrupt stop command signal Skt at the time t0, the brake actuation timing counting means 45 starts counting the elapsed time. At the same time, the control release timing counting means 43 also starts counting the elapsed time.

[At the Time t1]

At the brake actuation signal generation time t1, the count value of the brake actuation start timing counting means 45 reaches the preset brake actuation start timing set value T11. As a result, the brake actuation start timing counting means 45 outputs the mechanical brake actuation signal Sslc (from H-level to L-level) to the electromagnetic valve 17 through the logic processing means 46.

The electromagnetic valve 17 is actuated by the brake actuation signal Sslc. A predetermined time after the start of the operation, the air in the cylinder device 16 of the mechanical brake 15 is exhausted. Along with the exhaust of the air, the friction disc of the mechanical brake 15 starts moving (brake stroke).

Specifically, the command is previously issued at the time t1 so that the mechanical brake 15 actually starts braking at the time t31. The previously issued command is executed without determining or monitoring whether or not the runaway of the servomotor 10 or the like is occurring, and hence the timing of the brake operation is not actually delayed.

In FIGS. 7 and 8, an "in-cylinder pressure" illustrates a reduction in air pressure in the cylinder device 16, and a "brake stroke" illustrates the movement of the friction disc of the mechanical brake 15.

[At the Time t2]

At the control release signal generation time t2, the count value of the control release timing counting means 43 reaches the preset control release timing set value T21. As a result, the control release timing counting means 43 outputs the control release signal (from H-level to L-level) as the base drive interruption signal Sbc to the servo driver 21 through the logic processing means 44. The forcible control-release for the electromagnetic contactor interruption signal Scc is performed in the same manner, and hence the description thereof is herein omitted.

Upon reception of the base drive interruption signal Sbc (from H-level to L-level), the servo driver 21 causes the driving currents Iu, Iv, and Iw for the servomotor 10 to disappear after the actuation time period of the control relay 33 and the delay time period of other circuits.

[At the Time t3]

(In the Case of the Normal Operation)

The abrupt stop control means (50 and 20) functions to attenuate the rotation of the servomotor 10 according to the abrupt stop motion CRVs in the case of the rotation at the maximum speed (Vmax) illustrated in FIG. 7 so that the speed becomes zero (the rotation is stopped) at the scheduled stop time t3 after elapse of the scheduled control time period Ts (for example, 70 msec).

In the case of the rotation at the medium speed illustrated in FIG. 8, the abrupt stop control means functions to attenuate the rotation of the servomotor 10 according to abrupt stop motion CRVs-1 or CRVs-2 so that the speed becomes zero (the rotation is stopped) within the scheduled control time period Ts. In any of the cases, the servomotor 10 is stopped by the scheduled stop time t3.

(In the Case of the Motor Runaway)

When the servomotor 10 continues rotating (the runaway is occurring) at the maximum speed (or at the speed lower than the maximum speed) due to some reason (for example, the occurrence of the abnormality in the signal S11 to be fed back from the encoder 11 to the servo driver 21) although the switching to the abrupt rotation stop control is performed at the time t0, the servomotor 10 is still rotating after elapse of the scheduled control time period Ts.

The synchronous type motor (AC servomotor) is used as the servomotor 10 in this embodiment, and hence the driving force is not generated unless the rotation drive signal Sd corresponding to the magnetic pole (permanent magnet) of the rotor is input. Thus, it is hardly believed that the drive signal for the speed equal to or higher than the maximum speed Vmax is naturally generated as the signal corresponding to the magnetic pole of the rotor, and hence it is hardly supposed that the rotation speed exceeds the maximum speed Vmax even in the condition where the runaway of the servomotor 10 is occurring.

Specifically, when the servomotor 10 rotates at either of the maximum speed illustrated in FIG. 7 and the medium speed illustrated in FIG. 8, the speed of the servomotor 10 at the scheduled stop time t3 in the case where the runaway of the servomotor 10 or the like occurs is within the range of 0 to Vmax. It is believed that the highest rotation speed is Vmax.

[At the Time t31]

The electromagnetic valve 17 is actuated in response to the mechanical brake actuation signal Sslc to start the actuation of the mechanical brake 15. At the braking start time t31 which corresponds to a time after elapse of the adjustment time period Tf1 (for example, 10 msec) from the scheduled stop time t3, the movable-side friction disc is moved to be brought into contact with the fixed-side friction disc as indicated by the "brake stroke" illustrated in each of FIGS. 7 and 8, thereby starting braking. Specifically, at the time t31, the mechanical brake 15 actually starts braking.

[At the Time t32]

In response to the base drive interruption signal Sbc (from H-level to L-level), the driving currents Iu, Iv, and Iw for the servomotor are caused to disappear after the actuation time period of the control relay 33 and the delay time period of other circuits. As a result, at the time t32, that is, after elapse of the adjustment time period Tf2 (for example, 20 msec) from the scheduled stop time t3, a magnetic field of the servomotor 10 is caused to disappear to cause the driving force to disappear.

(In the Case of the Normal Operation)

In the case of the normal operation, the rotation stop control is terminated within the scheduled stop time period Ts. The rotation of the servomotor 10 is stopped, and the upward and downward movement of the slide 9 is stopped. The servomotor 10 operates normally in most of the cases in terms of probability, and hence the mechanical brake 15 merely maintains the stop state of the servomotor. Specifically, the wear of the friction discs of the mechanical brake 15 hardly occurs. Further, the abrupt stop control for the servomotor 10 is forcibly released to cause the driving currents supplied to the servomotor 10 to disappear, and hence the driving force is not generated in the servomotor 10 even if the abnormality occurs in the servo controller 28 or the servo driver 21 regardless of the type of abnormality. As a result, the stop state is maintained by the mechanical brake 15. Specifically, in this state, the hand and the like may be inserted safely into the dangerous area (work area).

(In the Case of the Motor Runaway)

When the runaway of the servomotor 10 is occurring due to some abnormality, the servomotor 10 is still rotated to operate the slide 9 even at the scheduled stop time t3. In the worst case, there is a possibility that the servomotor 10 rotates at the maximum rotation Vmax.

In such a case, the mechanical brake 15 starts braking at the braking start time t31 as illustrated in FIGS. 7 and 8 in this embodiment. After that, the air in the cylinder device 16 of the mechanical brake 15 is exhausted. The friction discs are pressed against each other with the full spring force (full biasing force of the spring), whereby the servomotor 10 is braked with the maximum capacity of the mechanical brake 15.

In parallel with the aforementioned operation, the driving force for the servomotor 10 disappears at the driving force disappearance time t32. Therefore, from then on, there is no driving force even when the servomotor 10 is in the runaway state. As a result, the servomotor 10 is decelerated to be stopped with the maximum capacity of the mechanical brake 15. In the case of the braking performed by the mechanical brake 15 on the servomotor rotating at the maximum speed Vmax, the servomotor 10 is decelerated according to the brake deceleration curve CRVs illustrated in FIG. 7 to be reliably stopped within the brake stop time period Tb (for example, 70 msec).

Thus, in this embodiment, it is understood that the mechanical brake 15 is not required to have the braking force superior to the driving force for the servomotor 10 and it is sufficient for the mechanical brake to have the braking force which stops the actuation due to the inertia force.

The runaway occurs at the maximum speed Vmax in some cases, and hence the wear of the friction discs in such a case is inevitable. However, the frequency of occurrence of the runaway at the maximum speed Vmax is extremely low. In addition, in view of the prevention of damages to the device and the physical human protection being regarded as the priority, such a small degree of burden is allowed as acceptable. In comparison with the case, where the power to the motor is constantly forcibly interrupted to place the motor in the free rotation state upon the generation of the abrupt stop command and the servomotor is stopped in this state only by a forcible braking operation performed by the mechanical brake (the friction discs of the brake constantly perform a full-capacity operation for braking in such a case, and hence the lifetime of the friction discs is shortened), an economic advantage, a shorter maintenance time, and higher production efficiency are provided.

(In the Case of the Medium Speed)

In the case where the runaway of the servomotor 10 is occurring, the speed at the braking start time t31 or the driving force disappearance time t32 is within the range of 0 to Vmax as described above. However, the speed at the aforementioned times may not be defined.

The deceleration curve CRVs-1 when the rotation speed is still the medium speed Vi at the aforementioned times is illustrated in FIG. 8. Specifically, when the servomotor 10 is braked by the mechanical brake 15 when the rotation speed is still the medium speed Vi, the servomotor 10 is decelerated to be stopped according to CRVs-1. In such a case, the servomotor is stopped within a shorter period of time as compared with the brake stop time period Tb when the servomotor is rotated at the maximum speed Vmax, and therefore, the higher safety is provided.

In other words, the servomotor 10 may be stopped within the maximum abrupt stop time period Tm under any circumstances in this embodiment, and hence the safe electric servo press may be provided.

[At the Time t4]

As described above, the servomotor 10 (specifically, slide 9 of the electric servo press 1) has been reliably stopped at the time t4 under any circumstances in this embodiment. A time period from the time t0 to the time t4 corresponds to the maximum abrupt stop time period Tm. The servomotor 10 may be reliably stopped within the maximum abrupt stop time period Tm. For example, as a specific example of the maximum abrupt stop time period in this embodiment, the following example may be assumed.

$$\text{Maximum abrupt stop time period } Tm(160\text{ msec})=Ts(70\text{ msec})+Tf2(20\text{ msec})+Tb(70\text{ msec})$$

The maximum abrupt stop time period Tm is the longest stop time period, and hence the safe distance (distance from the dangerous area to the scanning position of the intrusion detection device 62) by using specific numerical values (an example) in this embodiment is obtained (according to American National Standards).

$$\text{Safe distance } Ds(0.288)=1.6(Tm(0.16)+Tr(0.02)+Tbm(0))+Dpf(0)$$

K=1.6 m/sec (speed of the hand);

Tm: maximum stop time period (for example, 0.16 sec);

Tr: intrusion detection device response time period (for example, 0.02 sec);

Tbm: overrun monitoring time period (for example, 0 sec); and

Dpf: distance added depending on the performance of the intrusion detection device (for example, 0 sec).

In this case, the safe distance is 0.288 m, and the ray scanning position of the intrusion detection device 62 is required to be situated at a position 288 mm before the dangerous area (work area). This safe distance is almost equal to that of the conventional mechanical presses. Therefore, according to this embodiment, the operation ease and the productivity may be improved while the same or higher degree of safety as or than that of the mechanical press is ensured for the operator even with the electric servo press.

As described above, the air-release spring-clamping type mechanical brake 15 is used in this embodiment.

This type uses the air pressure to release the air, and hence a strong spring for pressing the friction discs against each other may be used. Thus, the structure is suitable for the brake requiring a large braking torque. Moreover, with the combination of the use of a large number of springs and the method of exhausting the air by using the double-solenoid valve, the aforementioned type may be provided with high reliability and certainty.

Moreover, the aforementioned type is used in many conventional mechanical presses, and is reliable in view of reliability such as product quality or the like and has high availability.

From the points of view described above, the aforementioned type is used even for the electric servo press according to this embodiment.

However, the aforementioned type of brake has a relatively long delay time period until the start of braking in comparison with an electromagnetic brake which uses an electromagnetic force to perform braking and the like because the actuation time period of the electromagnetic valve, the time period for exhausting the air in the cylinder device, and the like are required. Specifically, as illustrated in FIG. 7, in the case of the mechanical brake 15 used in this embodiment, the delay time period in the actuation of the mechanical brake is, for example, 60 msec.

A maximum abrupt stop time period Tm-m in the conventional mechanical press provided with the brake having similar performance to that of the mechanical brake 15 is as follows.

*Tm-m*(130 msec)=Actuation delay time period *T*12(60 msec)+Braking time period *Tb*(70 msec)

The maximum abrupt stop time period Tm of the electric servo press 1 in this embodiment is 160 msec as describe above, and hence the maximum abrupt stop time period is increased by 30 msec in comparison with the conventional mechanical presses.

However, the maximum abrupt stop time period of the electric servo press 1 corresponds to a stop time period when the mechanical brake 15 is actuated to stop the rotation of the servomotor 10 in the case where the rotation of the servomotor 10 may not be stopped by the rotation stop control. Even in such a case, an increase in the maximum abrupt stop time period is only 30 msec. Further, if the timing adjustment time periods Tf1 and Tf2 are set closer to zero, the maximum abrupt stop time period of the electric servo press 1 according to this embodiment is further reduced by 20 msec so as to be equal to 140 msec. Accordingly, the abrupt stop performance almost similar to that of the conventional mechanical press may be realized.

From another viewpoint, in this embodiment, the rotation stop control of the servomotor 10 is performed within the needless time period (actuation delay time period) in terms of the operation characteristics of the conventionally used mechanical brake. The mechanical brake 15 is actuated so that a time after elapse of the needless time period and the rotation stop time of the servomotor 10, which is scheduled in view of the characteristics of the rotation stop control of the servomotor 10, substantially coincide with each other, while the rotation stop control of the servomotor 10 and the interruption of the rotational drive power source are performed. In this manner, even if the runaway of the servomotor 10 is occurring, the servomotor 10 may be reliably stopped.

For example, if the brake is actuated after the deceleration state is monitored after the issuance of the deceleration stop command and the failure of normal deceleration is detected as described in Patent Document 5, the brake actuation is delayed by the needless time period in the case where the needless time period is present. Therefore, the mechanical brake may not be actuated at optimal timing. Further, if the maximum abrupt stop time period is intended to be reduced to as small as that of the present invention by using the method described in Patent Document 5, the braking is required to be performed earlier. Therefore, the use of a large-capacity mechanical brake having a larger braking force is inevitable.

On the other hand, according to this embodiment, a high degree of freedom in motion setting is provided to realize the use of the electric servo press for various types of press working, which is an advantage of the electric servo press. In addition, the economic electric servo press having the same level of abrupt stop performance as that of the conventional mechanical press with high safety and good operation efficiency and operability with little wear of the mechanical brake to allow a relatively long maintenance cycle of the mechanical brake may be provided.

For the abrupt stop control performed in the electric servo press, the number of the cases where the servomotor operates normally is overwhelmingly larger than that of the cases where the abnormality occurs. Therefore, according to the control method of this embodiment, although the mechanical brake maintains the stop state, the mechanical brake little contributes to the braking on the servomotor. Thus, in some cases, there is a possibility that the substantial braking is not performed by the mechanical brake until the lifetime of the electrical servo press comes to an end.

On the other hand, the electrical servo press is required to be able to brake and stop the servomotor without fail if needed.

Therefore, for example, a test mode for testing the braking force of the mechanical brake 15 may be provided so as to confirm that the rotation of the servomotor 10 may be stopped within the maximum abrupt stop time period only by the braking force of the mechanical brake 15 without executing the rotation stop control for the servomotor 10 at an appropriate timing such as before the start or the end of the press operation.

As described above, according to this embodiment, when the abrupt stop command Skt is generated, based on the generation, the normal press control is switched to the motor rotation stop control according to the abrupt stop motion CRVs. When the rotation of the servomotor 10 is not stopped after elapse of the scheduled stop time period Ts (at the scheduled stop time t3) in which the rotation of the servomotor 10 is scheduled to be stopped by the motor rotation stop control, the mechanical brake 15 is made to actually perform the brake operation and the rotational drive power source Vmt is forcibly interrupted. Therefore, in the case where the servomotor 10 operates normally, the electric servo press 1 may be abruptly stopped in response to the abrupt stop command. In addition, even in the case where the runaway of the servomotor occurs, the rotation of the servomotor may be reliably and quickly stopped within a predetermined time period. Thus, it is possible to respond to the abrupt stop request for the electric servomotor.

Further, the mechanical brake 15 is not overused as in the case of the abrupt stop control for the conventional electric servomotor, and hence a small-capacity mechanical brake is sufficient. In addition, the wear of the friction discs may be suppressed. Thus, the maintenance time and the cost may be reduced. Accordingly, the electric servo press with a small economic burden and a high productivity may be provided.

Further, in this embodiment, the control means is configured to include the abrupt stop forcible control-release means (50, 21, and 22) and the brake control means (50). Besides the abrupt control means (50 and 20), the storage means (50 and 28), the control release timing setting means (50, 55, and 56), the brake start timing setting means (50, 55, and 56), and the signal generation means 41 are provided. Thus, the electric servomotor is more easily embodied, and hence the electric servo press is expected to be widely diffused. Moreover, the handling is further facilitated, and hence a smooth operation is enabled.

Moreover, if the air-release spring-clamping type mechanical brake, which is widely used in the conventional mechanical presses, is used as the mechanical brake 15 as in this embodiment, ensured braking effects and high reliability are guaranteed.

Further, the servomotor 10 is configured so that the rotation stop control for the servomotor 10 is forcibly released by interrupting the motor driving currents I Iu, Iv, and Iw) for the servomotor 10, and hence a control state in which a dangerous runaway state of the servomotor 10 is, maintained for a long period of time is not created. Therefore, the runaway state of the servomotor 10 may be reliably eliminated.

In addition, the control signal Sc of the power transistors 25 is made to disappear by means of software, the base drive signal Sd is made to disappear by means of software, or further, the rotational drive power source Vmt is interrupted by means of hardware (or physically) to interrupt the motor driving currents I. Thus, the quick current interruption with high reliability may be ensured.

When the synchronous type motor which is rotationally driven only after the reception of the rotational driving signal Sd in synchronization with the position of the magnetic pole of the motor is used as the servomotor 10 as in this embodiment, the electric servo press which is more safer against the runaway of the rotation of the servomotor 10 may be provided.

In addition, the abrupt stop command signal is generated upon input of even any one of the emergency stop command signal Sem and the intrusion detection signal Sin in this embodiment, and hence the range of application for avoidance of danger is large. Further, if the configuration is such that the set timings (T1 and T2) are automatically adjustable according to the maximum speed based on the selected abrupt stop motion, the electric servo press which is further easy to handle may be provided while the quick maintenance of the motor stop position is enabled.

The embodiment described above is a mere exemplification for describing the present invention. Therefore, various changes may be made without departing from the spirit of the present invention.

INDUSTRIAL APPLICABILITY

The present invention may respond to a request for stopping the press operation within the shortest time period in response to the abrupt stop command while ensuring the elimination of the hard operating states of the mechanical brake in the case where the motor rotates normally. In addition, the present invention may respond to a request for reliably and quickly stopping the press even in the case where the runaway of the motor due to a mechanical or electrical failure or abnormality occurs. Thus, the present invention is effective as the electric servo press or the control system therefor.

The invention claimed is:

1. A method of controlling an electric servo press for converting rotation of an electronically-controlled servomotor through an intermediation of a power transmission/conversion mechanism into vertical reciprocating movement of a slide so as to use the vertical reciprocating movement of the slide to perform press-working on a workpiece, comprising:

executing rotation stop control for the servomotor according to a predetermined abrupt stop motion in response to an abrupt stop command; and causing a mechanical brake of the electric servo press to actually act to perform braking on an output of the servomotor, and stopping at least one of electronic control including at least the rotation stop control and drive power supply with respect to the servomotor under a condition that a predetermined time period elapses after start of the execution of the rotation stop control, wherein a time after elapse of the predetermined time period from the start of the execution of the rotation stop control is at or around a scheduled stop time at which the rotation of the servomotor is stopped by the execution of the rotation stop control in a case where the servomotor operates normally.

2. A control device for an electric servo press for converting rotation of an electronically-controlled servomotor through an intermediation of a power transmission/conversion mechanism into vertical reciprocating movement of a slide so as to use the vertical reciprocating movement of the slide to perform press-working on a workpiece, the control device being configured to:

execute rotation stop control for the servomotor according to a predetermined abrupt stop motion in response to an abrupt stop command; and cause a mechanical brake of the electric servo press to actually act to perform braking on an output of the servomotor, and stop at least one of electronic control including at least the rotation stop control and drive power supply with respect to the servomotor under a condition that a predetermined time period elapses after start of the execution of the rotation stop control, wherein a time after elapse of the predetermined time period from the start of the execution of the rotation stop control is at or around a scheduled stop time at which the rotation of the servomotor is stopped by the execution of the rotation stop control in a case where the servomotor operates normally.

3. A control device for an electric servo press according to claim 2, wherein the stop of the at least one of the electronic control including at least the rotation stop control for the servomotor and the drive power supply includes interruption of a control signal line or a drive power supply line connected to the servomotor by means of hardware.

4. A control device for an electric servo press according to claim 2, wherein the stop of the drive power supply with respect to the servomotor includes at least one of disappearance of a control signal for power transistors constituting a part of a servomotor drive circuit to cause a base drive signal for the power transistors to disappear and interruption of a driving current supplied to the servomotor by an electromagnetic contactor.

5. A control device for an electric servo press for converting rotation of an electronically-controlled servomotor through an intermediation of a power transmission/conversion mechanism into vertical reciprocating movement of a slide so as to use the vertical reciprocating movement of the slide to perform press-working on a workpiece, comprising:

an abrupt stop control device configured to execute rotation stop control for the servomotor based on an abrupt stop motion stored in storage device upon generation of an abrupt stop command; and a control device configured to instruct a mechanical brake of the electric servo press to start a braking operation on an output of the servomotor at a predetermined brake actuation start timing when the rotation stop control is executed by the abrupt stop control device and for instructing to stop the rotation stop control executed by the abrupt stop control device at a predetermined control release timing, wherein the predetermined brake actuation start timing is set to cause the mechanical brake of the electric servo press to actually act to perform braking on the output of the servomotor at or around a scheduled stop time at which the rotation of the servomotor is stopped by the execution of the rotation stop control in a case where the servomotor operates normally, and wherein the predetermined control release timing is set so that the rotation stop control by the abrupt stop control device is actually stopped at or around a scheduled stop time at which the rotation of the servomotor is stopped by the execution of the rotation stop control in a case where the servomotor operates normally.

6. A control device for an electric servo press according to claim 5, wherein the control device executes control for stopping the drive power supply to the servomotor at or around a scheduled stop time at which the rotation of the servomotor is stopped by the execution of the rotation stop control in a case where the servomotor operates normally.

7. A control device for an electric servo press according to claim 5, wherein the stop of the execution of the rotation stop control performed by the abrupt stop control device, the stop being executed by the control device, includes control for interrupting a control signal line connected to the servomotor by means of hardware.

8. A control device for an electric servo press according to claim 6, wherein the control for stopping the drive power supply to the servomotor, the control being executed by the control device, includes control for interrupting a drive power supply line connected to the servomotor by means of hardware.

9. A control device for an electric servo press according to claim 6, wherein the control for stopping the drive power supply to the servomotor, the control being executed by the control device, includes at least one of control for causing a control signal for power transistors constituting a part of a servomotor drive circuit to disappear to cause a base drive signal for the power transistors to disappear and control for interrupting a driving current supplied to the servomotor by an electromagnetic contactor.

10. A control device for an electric servo press according to claim 5, further comprising at least a section for storing the predetermined brake actuation start timing, a section for instructing the mechanical brake of the electric servo press to start a braking operation on the output of the servomotor at the predetermined brake actuation start timing, a section for storing the predetermined control release timing, and a section for instructing the stop of the execution of the rotation stop control performed by the abrupt stop control device at the predetermined control timing, which are configured with redundancy to increase reliability in safety.

11. A control device for an electric servo press according to claim 5, wherein a time at which the mechanical brake of the electric servo press is caused to actually act to perform braking on the output of the servomotor coincides with or is a predetermined time earlier than a time at which the rotation stop control with respect to the servomotor is stopped.

12. A control device for an electric servo press according to claim 5, wherein the servomotor is a synchronous type motor rotationally driven in response to a rotation drive signal, which is synchronous with a position of a magnetic pole of a rotor.

13. A control device for an electric servo press according to claim 5, wherein the scheduled stop time is a scheduled stop time, at which the rotation of the servomotor is stopped by the execution of the rotation stop control from a state in which the servomotor is being operated at a maximum speed or a state in which the electric servo press is being operated at a maximum speed, regardless of a rotation speed of the servomotor before the execution of the rotation stop control.

14. A control device for an electric servo press according to claim 5, wherein the scheduled stop time is changed according to a rotation speed and a target deceleration rate of the servomotor before the execution of the rotation stop control.

15. An electric servo press comprising the control device for an electric servo press according to claim 2.

* * * * *